US007350893B2

(12) United States Patent
Teshigawara et al.

(10) Patent No.: US 7,350,893 B2
(45) Date of Patent: Apr. 1, 2008

(54) INKJET PRINTING METHOD

(75) Inventors: Minoru Teshigawara, Yokohama (JP); Naoji Otsuka, Yokohama (JP); Kiichiro Takahashi, Yokohama (JP); Osamu Iwasaki, Tokyo (JP); Tetsuya Edamura, Kawasaki (JP); Naomi Oshio, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/515,846

(22) Filed: Sep. 6, 2006

(65) Prior Publication Data

US 2007/0002096 A1 Jan. 4, 2007

Related U.S. Application Data

(63) Continuation of application No. pct/jp2005/010563, filed on Jun. 9, 2005.

(30) Foreign Application Priority Data

Jun. 9, 2004 (JP) ..... 2004-171741

(51) Int. Cl.
*B41J 2/205* (2006.01)

(52) U.S. Cl. ..... 347/15; 347/43

(58) Field of Classification Search ..... None
See application file for complete search history.

(56) References Cited

U.S. PATENT DOCUMENTS

| | | | | |
|---|---|---|---|---|
| 5,610,637 | A * | 3/1997 | Sekiya et al. | 347/10 |
| 7,097,267 | B2 * | 8/2006 | Kato et al. | 347/15 |
| 2004/0046817 | A1 | 3/2004 | Kato et al. | 347/15 |
| 2004/0070638 | A1 | 4/2004 | Takahashi et al. | 347/12 |

FOREIGN PATENT DOCUMENTS

| | | |
|---|---|---|
| EP | 1 396 345 | 3/2004 |
| EP | 1 405 724 | 4/2004 |
| JP | 2004-98464 | 4/2004 |
| JP | 2004-142452 | 5/2004 |

* cited by examiner

*Primary Examiner*—Lamson Nguyen
*Assistant Examiner*—Justin Seo
(74) *Attorney, Agent, or Firm*—Fitzpatrick, Cella, Harper & Scinto

(57) ABSTRACT

The present invention suppresses the adverse effect of air currents resulting from ink ejection, regardless of the mov ing speed of a print head, to allow high-grade images to be printed. Input image data is converted into print data corresponding to each of a plurality of nozzle arrays so that an amount of ink droplets ejected from each of the plurality of nozzle arrays and ejected per unit area is different depending on the moving speed of the print head.

6 Claims, 20 Drawing Sheets

INKJET PRINTING METHOD

This application is a continuation of PCT/JP2005/010563, filed Jun. 9, 2005, which claims priority of JP 2004-171741, filed Jun. 9, 2004.

TECHNICAL FIELD

The present invention relates to an inkjet printing method of using a print head in which a plurality of nozzle arrays are formed and ejecting ink droplets from nozzles in the nozzle arrays, while moving the print head, to print images on various print media.

The present invention is applicable to any instruments using print media such as paper, cloths, leather, nonwoven fabrics, OHP sheets, or metal. Specific application instruments include office instruments such as printers, copiers, and facsimile machines as well as industrial production instruments.

BACKGROUND ART

OA instruments such as personal computers and word processors are now in common use. Various printing apparatuses and methods have thus been developed to print information input via these instruments, on various print media. In particular, owing to their improved information processing capabilities, OA instruments tend to process colored video information. More and more printing apparatuses that output processed information also handle colored images. Various printing apparatuses capable of printing colored images are available and offer various costs and functions. Some printing apparatuses are inexpensive and provide relatively simple functions. Others provide a large number of functions and allow users to select printing speed or image quality depending on the type of images to be printed or the purpose of usage.

Inkjet printing apparatuses can make reduced noise, offer reduced running costs and sizes, and print colored images. Inkjet printing apparatuses are thus widely utilized in printers, copiers, facsimile machines, and the like. In general, color inkjet printing apparatuses print colored images using three color inks, cyan, magenta, and yellow inks, or four color inks, these three inks plus black ink. Conventional inkjet printing apparatuses generally use dedicated paper with an ink absorbing layer as print media in order to print colored images with colors excellently developed, without ink bleeding. Ink is now adapted to suit "ordinary paper", which is used for printers, copiers, and the like in large quantities.

What is called a serial scan type inkjet printing apparatus uses an inkjet print head in which nozzle groups corresponding to ink colors used for printing are disposed, as printing means for executing color printing using a plurality of color inks. The print head can eject ink from ejection openings constituting the nozzles. The serial scan type inkjet printing apparatus sequentially prints images on print medium by alternately repeating an operation of moving the print head in a main scanning direction, while ejecting ink from the ejection openings in the print head, and an operation of conveying print medium in a sub-scanning direction crossing the main scanning direction. Thus, what is called a horizontal arrangement print head is used in which nozzle groups (groups of nozzles used) corresponding to ink colors used for printing are sequentially horizontally disposed along the main scanning direction. The horizontal arrangement head can eject ink droplets from the nozzle groups onto the same raster during the same printing scan.

To allow the inkjet printing apparatus with the horizontal arrangement head to realize high-resolution printing in order to print images of higher image quality, it is effective to use a high-density print head in which print elements including nozzles are more densely integrated. A high-density print head manufactured by using a semiconductor process has recently emerged. High-density print heads with nozzles formed at 600 dpi (about 42.3 μm) have thus been manufactured.

Moreover, print heads have been manufactured in which a nozzle array corresponding to each ink color is divided into a plurality of parallel nozzle arrays arranged so that the nozzles in one nozzle array are offset from the nozzles in another line by a predetermined amount in the sub-scanning direction. For example, if each nozzle array has a nozzle arrangement density of 600 dpi, two such nozzle arrays are arranged in parallel so that the nozzles in one of the nozzle arrays are offset from the nozzles in the other by 1,200 dpi (about 21.2 μm) in the sub-scanning direction. This results in a print head with a high density of 1,200 dpi.

Another method for printing higher-quality images is a reduction in the size of each ink droplet for image printing. To reduce the size of each droplet, it is effective to use a print head having smaller print elements, including nozzles, able to eject smaller ink droplets. A print head that can eject 4 to 5 pl of ink has recently emerged. Print heads that are advantageous for high-definition printing have thus been manufactured.

Higher-quality images can be printed by thus ejecting smaller ink droplets from densely arranged nozzles.

However, with a horizontal arrangement head, inks ejected from a plurality of nozzle arrays arranged in the main scanning direction may affect one another. Specifically, ink droplets ejected from the nozzles draw in the surrounding air. Thus, when the print head moves at a high speed in the main scanning direction simultaneously with ejection of a large number of ink droplets, an air flow (air current) occurs, which may affect the ejection of the ink.

Now, a specific description will be given of the mechanism of generation of such an air current. First, with reference to FIG. 1, description will be given of how an air current results from operation of a print head.

FIG. 1 is a diagram of an ejection opening formation surface of a print head H as viewed from above. Ejection openings constituting nozzles N are formed in the ejection opening formation surface. Reference characters L1 and L2 denote nozzle arrays from each of which ink is ejected in a direction orthogonal to the sheet of FIG. 1. The print head H executes printing by ejecting ink from the nozzles N in the nozzle arrays L1 and L2 while moving in the main scanning direction, shown by arrow X in FIG. 1. On this occasion, ink droplets ejected vertically below the nozzles N in the nozzle array L1 draw in the surrounding air to form a "gas wall" that moves in the direction of arrow X. The "gas wall" moves in the direction of arrow X to cause air to flow beyond the gas wall to behind it, resulting in an air current flowing in the direction of arrow A in FIG. 1. This air current flows to the front of the nozzle array L2 to affect ink droplets ejected from the nozzles N in the nozzle array L2. The direction of the ejection may thus be shifted.

FIG. 2 is a diagram of the print head H as viewed from its side. This figure shows the flow of air behind the "gas wall". Ink droplets are ejected from the nozzles N in the nozzle arrays L1 and L2 in the direction of arrow B to cause air to flow downward. The direction of the air flow may change near print medium W so that the air flows rearward as shown by arrow A.

FIG. 3 is a diagram of the print head H as viewed from its front in the main scanning direction; FIG. 3 focuses on the nozzle array L2. In FIG. 3, ink droplets ejected from the nozzles (end nozzles) located at an end of the nozzle array L2 may have their ejecting direction bent toward the longitudinal center of the nozzle array L2 as the ink droplets approach the print medium W, owing to the adverse effect of the air current flowing in the direction of arrow A. If the ejecting direction is bent in that manner, the ink droplets ejected from the end nozzles impact the print medium W at positions that are offset from the original impacting positions toward the longitudinal center of the nozzle array L2. This is recognized as an image defect as is the case with a shift in (bias of) the ejecting direction of ink droplets or non-ejection of ink droplets. The cause of this phenomenon is both the air current flowing to behind the "gas wall", described with reference to FIG. 1 and the air current resulting from ink ejection as described with reference to FIG. 2; these air currents bend the ejecting direction of ink droplets ejected from the end nozzles.

As described above, a printing apparatus with the conventional horizontal arrangement print head may suffer an image defect caused by air currents resulting from ejection of ink droplets.

Patent Document 1 describes a method used for a multipass printing system of scanning a print head a number of times to complete a predetermined print area; the method controls the amount of ink applied taking into account the relationship between the number of scans (passes) and the adverse effect of air currents. That is, this method controls the amount of ink applied depending on the number of passes in order to avoid the adverse effect of the air currents.

Patent Document 1: European Patent Application Laid-open No. 1405724

DISCLOSURE OF THE INVENTION

Possible means for meeting recent requirements for an increase in printing speed is a method of increasing the driving frequency of a print head, that is, increasing the speed of movement of the printing head in the main scanning direction. In this case, the level of the above adverse effect of air currents varies with the moving speed of the print head. For example, even with the same number of passes for printing, a variation in the moving speed of the print head significantly varies the level of adverse effect of air currents on ejected ink droplets. Of course, the level of adverse effect of air currents increases consistently with the speed of the print head. This may lower the accuracy with which ink impacts the print medium to degrade images.

An object of the present invention is to provide an inkjet printing method that generates print data so as to avoid the possible adverse effect of air currents resulting from ink ejection, thus enabling high-grade images to be printed regardless of the moving speed of the print head.

The present invention provides an inkjet printing method for printing an image on a print medium by ejecting ink droplets from a plurality of nozzle arrays of a print head on the basis of print data while moving the print head in a direction crossing a predetermined direction, each of the plurality of nozzle arrays having a plurality of nozzles which are arranged in the predetermined direction, the method comprising: a step of specifying one of a plurality of print modes in which the print head moves the same number of times but at different speeds in order to print a predetermined area of the print medium; and a conversion step of converting input image data into the print data corresponding to each of the plurality of nozzle arrays so that an amount of ink droplets ejected, per unit area of the print medium, from the plurality of nozzle arrays is different depending on the specified print mode.

The present invention provides an inkjet printing method for printing an image on print medium by ejecting ink droplets from the plurality of nozzle arrays of a print head on the basis of print data while moving the print head in a direction crossing a predetermined direction, each of the plurality of nozzle arrays having a plurality of nozzles which are arranged in the predetermined direction, the method comprising: a step of specifying one of a plurality of print modes in which the print head moves the same number of times but at different speeds in order to print a predetermined area of the print medium; and a conversion step of executing an image process corresponding to the specified print mode to convert input image data into the print data corresponding to each of the plurality of nozzle arrays, and wherein a plurality of the image processes corresponding to the plurality of print modes convert the input data indicating a predetermined luminance level into the print data by which ink droplets are ejected from the plurality of nozzle arrays at different amounts ejected per unit area of the print medium.

The present invention provides an inkjet printing method for nozzle array printing an image on print medium by ejecting the inks from the first and second nozzle arrays of a print head on the basis of print data while moving the print head in a direction crossing a predetermined direction, the print head comprising at least the first nozzle array having a plurality of nozzles which are arranged in the predetermined direction and the second nozzle array having a plurality of nozzles which are arranged in the predetermined direction, the color of ink ejected from the first nozzle array being same as the color of ink ejected from the second nozzle array and the amount of ink ejected from the first nozzle arrays being different from that ejected from the second nozzle array, the method comprising: a step of specifying one of a plurality of print modes in which the print head moves the same number of times but at different speeds in order to print a predetermined area of the print medium; and a conversion step of converting input image data into the print data corresponding to each of the first and second nozzle arrays so that an amount of ink droplets ejected from the first and second nozzle arrays per unit area of the print medium is different depending on the specified print mode.

The present invention provides an inkjet printing method using a print head comprising a plurality of nozzle arrays each having a plurality of nozzles which are arranged in a predetermined direction and from which ink droplets can be ejected, the method printing an image on print medium by ejecting ink droplets from the plurality of nozzle arrays on the basis of print data while moving the print head in a direction crossing the predetermined direction, the method comprising: a conversion step of converting input image data into the print data corresponding to each of the plurality of nozzle arrays so that an amount of ink droplets ejected from the plurality of nozzle arrays per unit area of the print medium is different depending on the moving speed of the print head and an opposite spacing between the print head and the print medium.

The present invention provides an inkjet printing method using a print head comprising a plurality of nozzle arrays each having a plurality of nozzles which are arranged in a predetermined direction and from which ink droplets can be ejected, the method printing an image on print medium by ejecting ink droplets from the plurality of nozzle arrays on the basis of print data while moving the print head in a direction crossing the predetermined direction, the method comprising: a step of specifying one of a plurality of print modes including a first print mode in which the print head is moved at a first moving speed and a second print mode in which the print head is moved at a second print speed that is higher than the first moving speed; and a conversion step of converting input image data into the print data corresponding to each of the plurality of nozzle arrays depending on the specified print mode, and wherein the maximum amount of ink ejected per unit area of the print medium which amount is indicated by the print data obtained in the conversion step is smaller when the second print mode is specified than when the first print mode is specified.

The present invention provides an inkjet printing method using a print head comprising a plurality of nozzle arrays each having a plurality of nozzles which are arranged in a predetermined direction and from which ink droplets can be ejected, the method printing an image on print medium by ejecting ink droplets from the plurality of nozzle arrays on the basis of print data while moving the print head in a direction crossing the predetermined direction, the method comprising: a step of specifying one of a plurality of print modes including a first print mode in which the print head is moved at a first moving speed and a second print mode in which the print head is moved at a second print speed that is higher than the first moving speed; and a conversion step of converting input image data into the print data corresponding to each of the plurality of nozzle arrays depending on the specified print mode, and wherein the maximum amount of ink ejected per unit area of the print medium which amount is indicated by the print data obtained in the conversion step is smaller when the second print mode is specified than when the first print mode is specified.

The present invention converts input image data into print data corresponding to each of a plurality of nozzle arrays depending on the moving speed of a print head so that different amounts of ink droplets ejected from the plurality of nozzle arrays are applied per unit area. This enables print data to be generated while avoiding the possible adverse effect of air currents resulting from ink ejection. As a result, high-grade images can be printed regardless of the moving speed of the print head.

Further features of the present invention will become apparent from the following description of exemplary embodiments (with reference to the attached drawings).

BEST MODE FOR CARRYING OUT THE INVENTION

An embodiment of the present invention will be described below with reference to the drawings. The present example corresponds to an application of a serial printer type inkjet printing apparatus having a plurality of print heads.

(Configuration of the Printing Apparatus)

Figure 1:
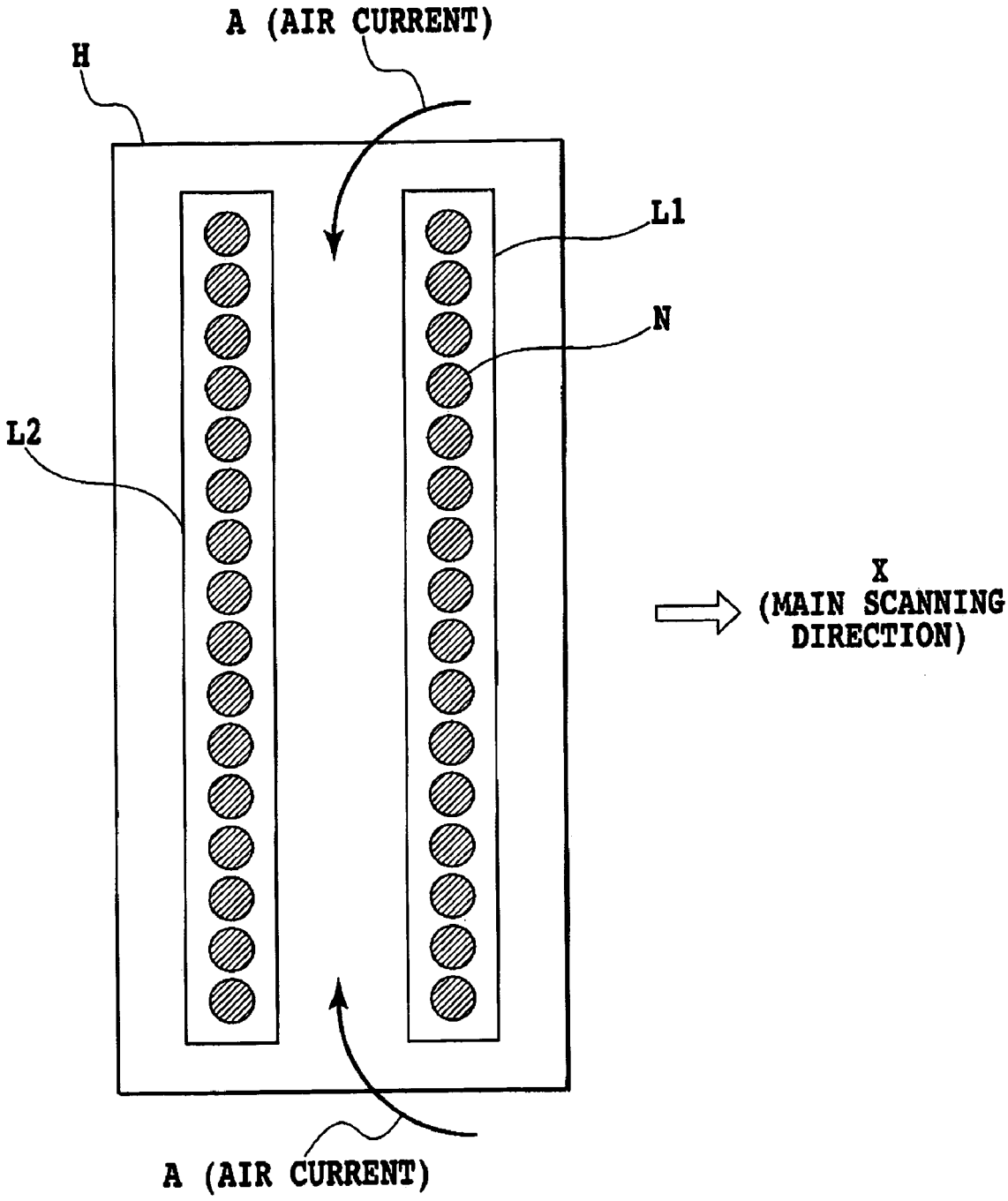
FIG. 1 is a diagram of a print head as viewed from above, the diagram illustrating how air currents result from ink ejection.
Figure 2:
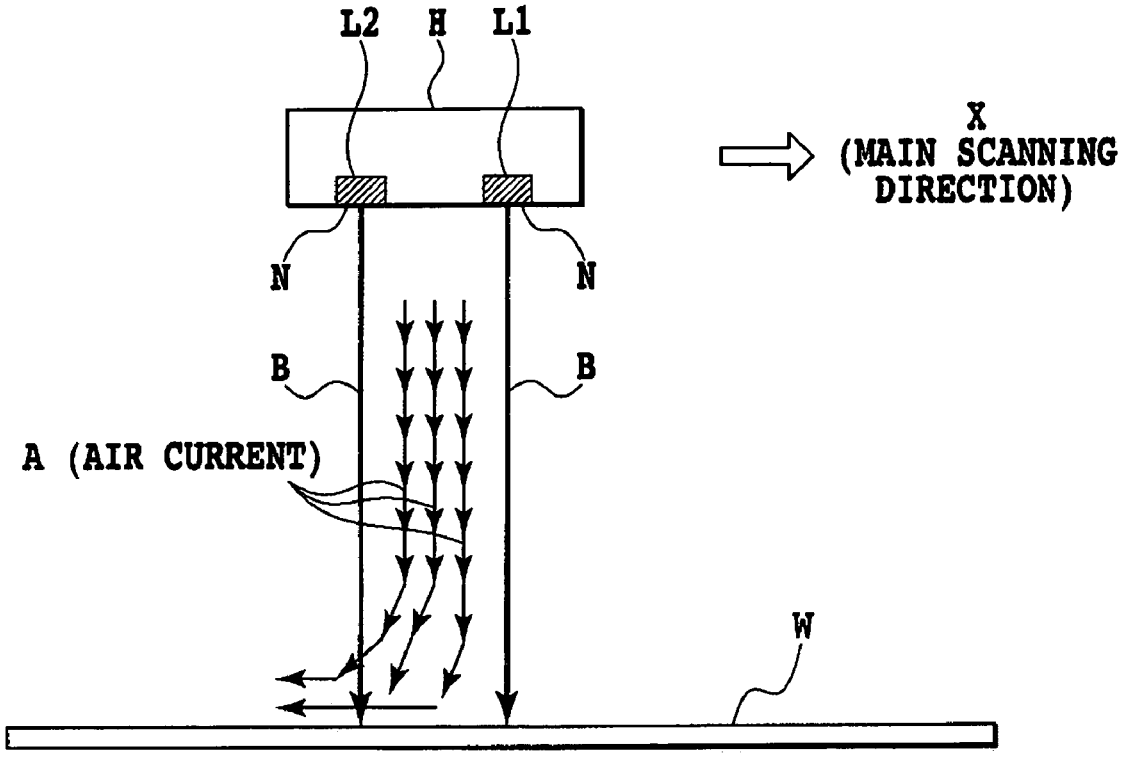
FIG. 2 is a diagram of the print head as viewed from its side, the diagram illustrating how air currents result from ink ejection.
Figure 3:
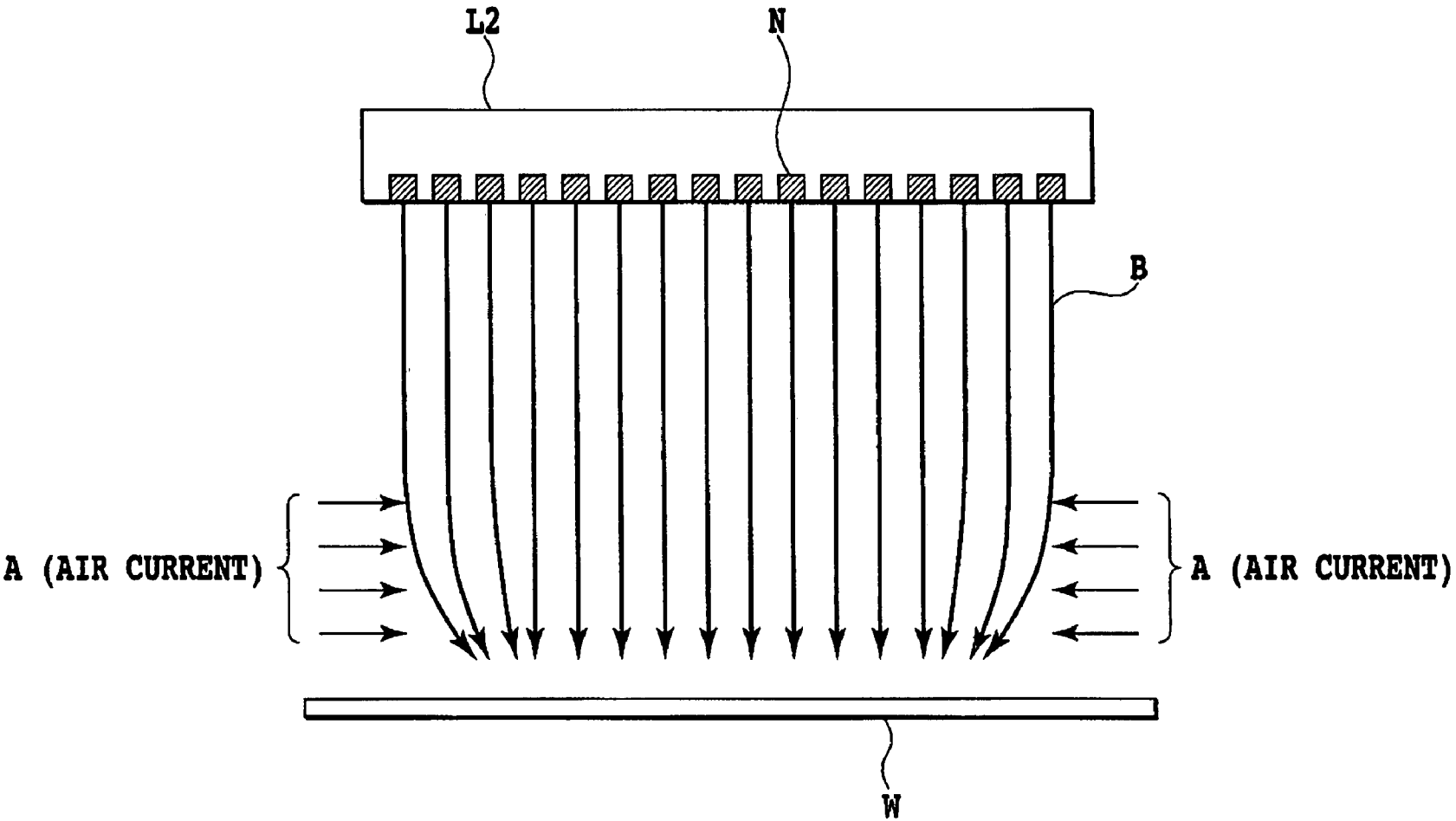
FIG. 3 is a diagram of the print head as viewed from its advancing direction, the diagram illustrating how air currents result from ink ejection.
Figure 4:
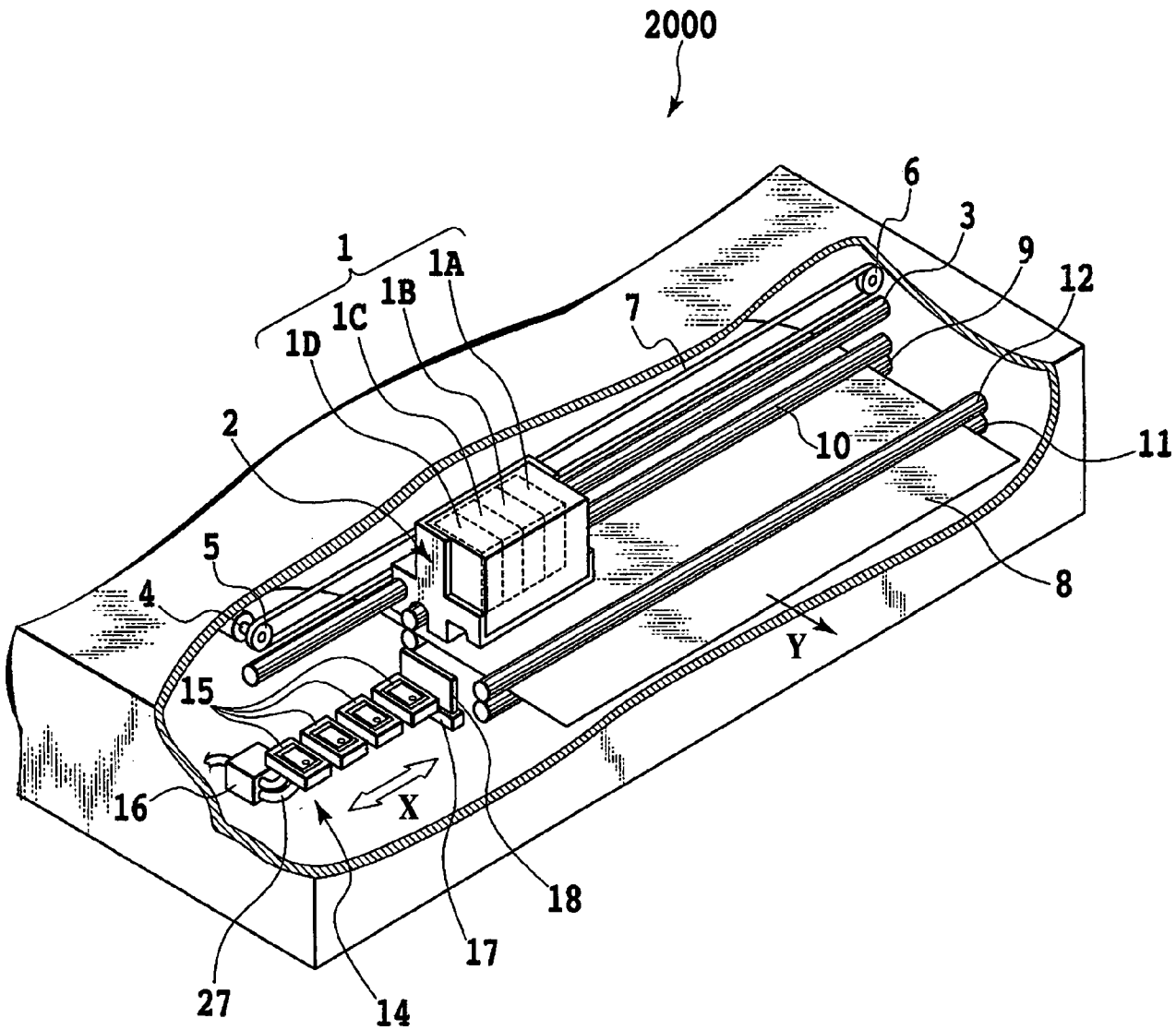
FIG. 4 is a partly cutaway perspective view of an inkjet printing apparatus to which the present invention is applicable.

FIG. 4 is a schematic diagram of an essential part of an inkjet printing apparatus to which the present invention is applicable.

In FIG. 4, a plurality of (four) head cartridges 1A, 1B, 1C, and 1D are replaceably mounted on a carriage 2. Each of the cartridges 1A to 1D includes a print head that can eject ink, an ink tank portion that supplies ink to the print head, and a connector that receives a signal driving the print head. In the description below, the whole or an arbitrary one of the cartridges 1A to 1D is also called a print head 1.

The head cartridges 1A to 1D execute printing using different color inks. The ink tank portions of the head cartridges 1A to 1D house different inks, for example, cyan (C), magenta (M), yellow (Y), and black (Bk) inks. The head cartridges 1A to 1D are replaceably mounted on the carriage 2, provided with a connector holder (electric connecting section) through which driving signals and the like are transmitted to the print heads via the connectors in the cartridges 1A to 1D.

The carriage 2 is guided by a guide shaft 3 so as to be movable in a main scanning direction, shown by arrow X; the guide shaft 3 is installed in the apparatus main body. The carriage 2 is driven by a main scanning motor 4 via a motor pulley 5, a driven pulley 6, and a timing belt 7 so as to have its position and movement controlled. Print medium 8 such as sheet or plastic thin plate is conveyed (fed) by two sets of rotating conveying rollers 9, 10 and 11, 12 through a position (printing section) where it lies opposite an ejection opening surface of the print head. Ejection openings constituting the nozzles are formed in the ejection opening surface of the print head 1. The print head 1 can eject ink droplets from the ejection openings. The print medium 8 has its back surface supported by a platen (not shown) so as to form a flat print surface in the printing section. The ejection opening surface of the print head 1 in each of the cartridges mounted on the carriage 2 projects downward from the carriage 2 so as to lie opposite the print surface of the print medium 8 between the two sets of conveying rollers 9, 10 and 11, 12.

The print head 1 in the present example is an inkjet print head that utilizes thermal energy to eject ink. The print head 1 comprises an electrothermal converter (heater) that generates thermal energy. Specifically, thermal energy generated by the electrothermal converter is used to cause film boiling in the ink in the nozzles. Bubbles thus grow and contract to cause a pressure change, which is used to eject ink droplets from the ejection openings. An ink ejecting scheme for the print head 1 is not specified. For example, a piezoelectric element may be used to eject ink.

Figure 5:
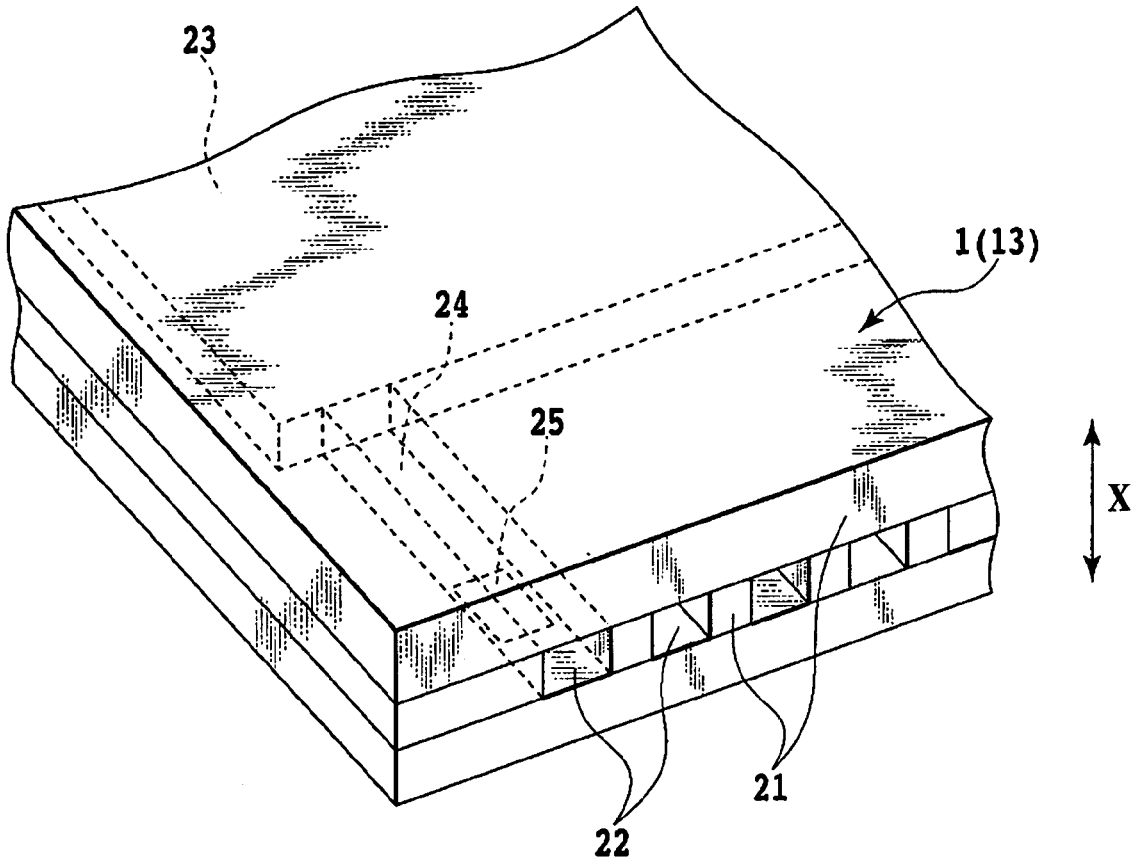
FIG. 5 is a schematic perspective view of an ink ejecting portion of a print head used in the inkjet printing apparatus in FIG. 4.

FIG. 5 is a schematic perspective view of an essential part of the ink ejecting section 13 of the print head 1. In FIG. 5, a plurality of ejection openings 22 are formed, at a predetermined pitch, in the ejection opening surface 21, which lies opposite the print medium 8 with a predetermined spacing (about 0.5 to 2 [mm]) between them. A common liquid chamber 23 to which ink is supplied is in communication with each ejection port 22 via a corresponding channel 24. An electrothermal converter (heating resistor) 25 is disposed along the surface of wall of each channel 24. The print head 1 is mounted on the carriage 2 so as to line up the ejection openings 22 in the direction crossing the scanning direction (direction of arrow X) of the carriage 2. The electrothermal converter 25 is driven (energized) on the basis of an image signal or ejection signal to cause film boiling in the ink in the corresponding channel 24. The resulting pressure can then be used to eject ink droplets from the ejection openings 22.

(Configuration of the Printing System)

Figure 6:
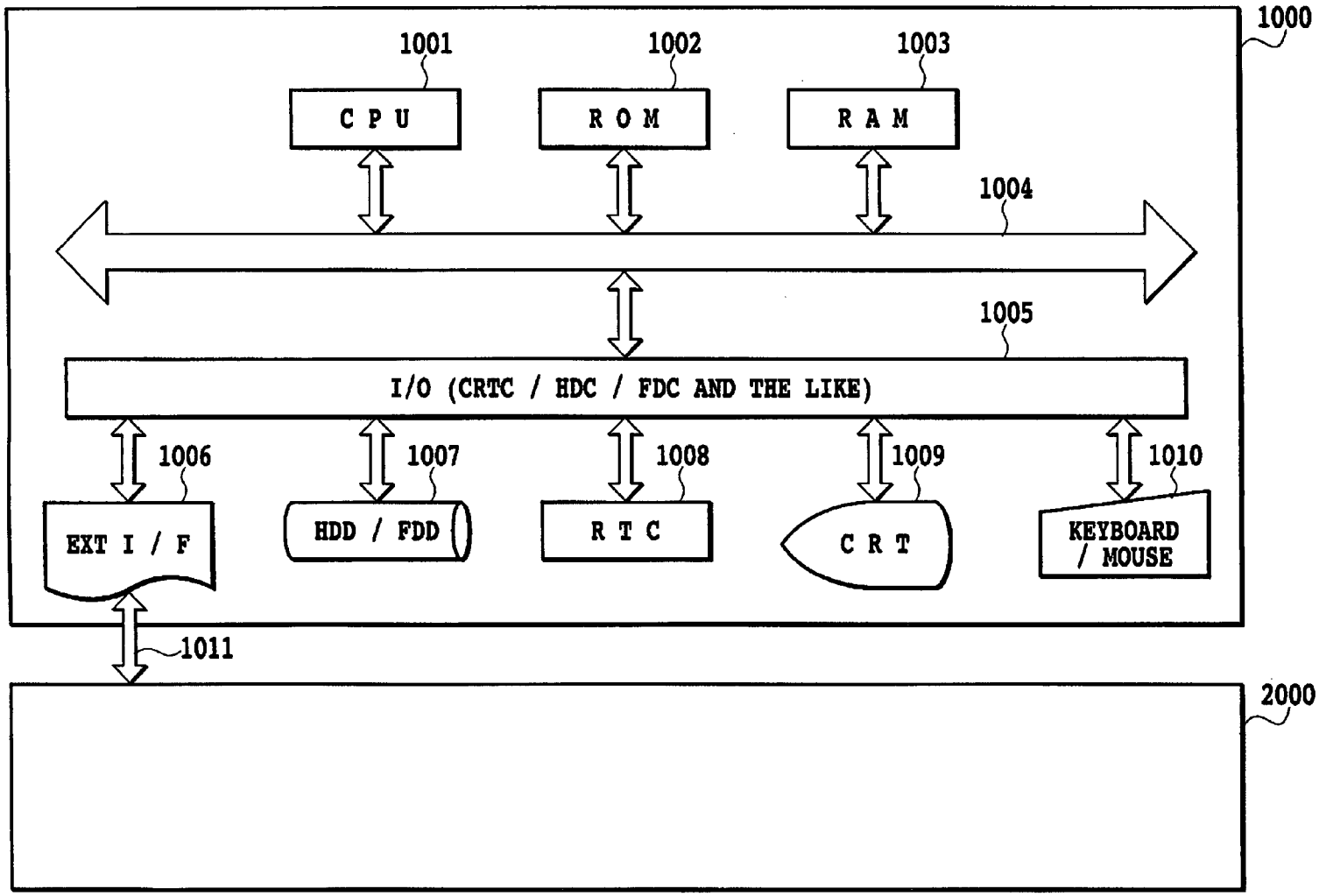
FIG. 6 is a diagram schematically showing the configuration of a printing system including the inkjet printing apparatus in FIG. 4.

FIG. 6 is a block diagram showing the hardware configuration of a printing system to which the present invention is applied by way of example. The system according to the present invention is generally composed of a host apparatus 1000 that carries out generation of print data, setting of a UI (User Interface) for the generation, and the like, and an inkjet printing apparatus 2000 that forms an image on print medium on the basis of the print data.

The host apparatus (host computer) 1000 comprises a CPU 1001, a ROM 1002, a RAM 1003, a system bus 1004, an I/O controller (CRTC, HDC, FDC, or the like) for various I/O instruments, an external interface (I/F) 1006, an external storage device (HDD/FDD) 1007 such as a hard disk drive (HDD) or a floppy (registered trade mark) disk drive (FDD), a real time clock (RTC) 1008, a CRT 1009, and an I/O device 1010 such as a keyboard and a mouse.

The CPU 1001 operate on the basis of an application program copied from the external storage device 1007 or the like to the RAM 1003, a communication program, a printer driver, an operating system (OS), or the like. At power-on, the ROM 1002 is booted, and the OS is loaded from the external storage device 1007 or the like into the RAM 1003. An application program, driver software, and the like are similarly loaded to allow the system to function. The external I/F 1006 sequentially transmits print data spooled in the RAM 1003 or external storage device 1007 (HDD), to the storage device 2000. The input device 1010 loads instruction data from a user into the host computer via the I/O controller 1005. The RTC 1008 clocks a system time to, for example, acquire and set time information via the I/O controller 1005. The CRT 1009 is a display device controlled by the CRTC in the I/O controller 1005. The blocks of the CRT 1009 and input device 1010 constitute a user interface.

Figure 7:
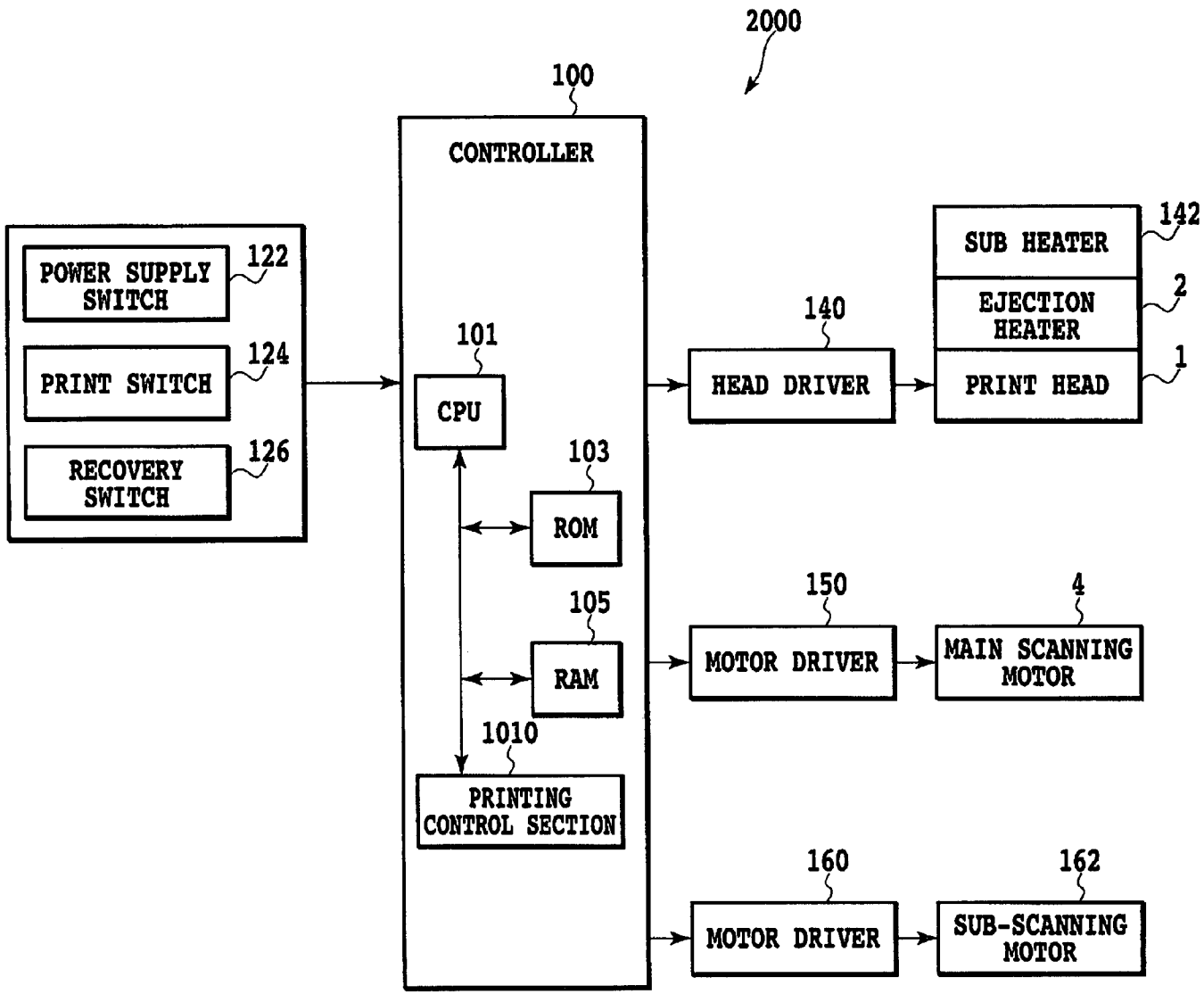
FIG. 7 is a block diagram of a control system of the inkjet printing apparatus in FIG. 4.

FIG. 7 is a block diagram of a control system in the inkjet printing apparatus 2000 in FIG. 6.

In FIG. 7, a controller 100 is a main control section having a CPU 101 in microcomputer form, a ROM 103 in which programs, required tables, and fixed data are stored, a RAM 105 provided with an area in which print data is expanded, a work area, and the like, and a printing control section 1010 shown in FIG. 13, described later. Print data, commands, status signals, and the like are transmitted between the host apparatus 1000 and the controller 100 via an interface (I/F; not shown).

An operation section 120 is a group of switches that receive the operator's instruction inputs. The group of switches include a power supply switch 122, a switch 124 for instructing printing to be started, and a recovery switch 126 for instructing suction recovery to be activated. A head driver 140 drives the electrothermal converter (hereinafter referred to as an "ejection heater") 25 in the print head 1. The head driver 140 has a shift register that aligns print data in association with the positions of the ejection heaters 25, a latch circuit that latches print data at an appropriate time, a logic circuit element that actuates the ejection heater 25 in synchronism with a driving timing signal, and a timing setting section that appropriately sets a driving timing (ejection timing) to align ink dot formation positions.

In the present example, the print head 1 is provided with a sub heater 142 that adjusts temperature in order to stabilize the ink ejection characteristics of the print head 1. For example, the sub heater 142 may be formed on a substrate simultaneously with the ejection heater 25 or mounted in the print head main body or head cartridge.

A motor driver 150 drives the main scanning motor 4 that moves the carriage 2 in the main scanning direction. A motor driver 160 drives a sub-scanning motor that conveys the print medium 8 in the sub-scanning direction.

Figure 8:
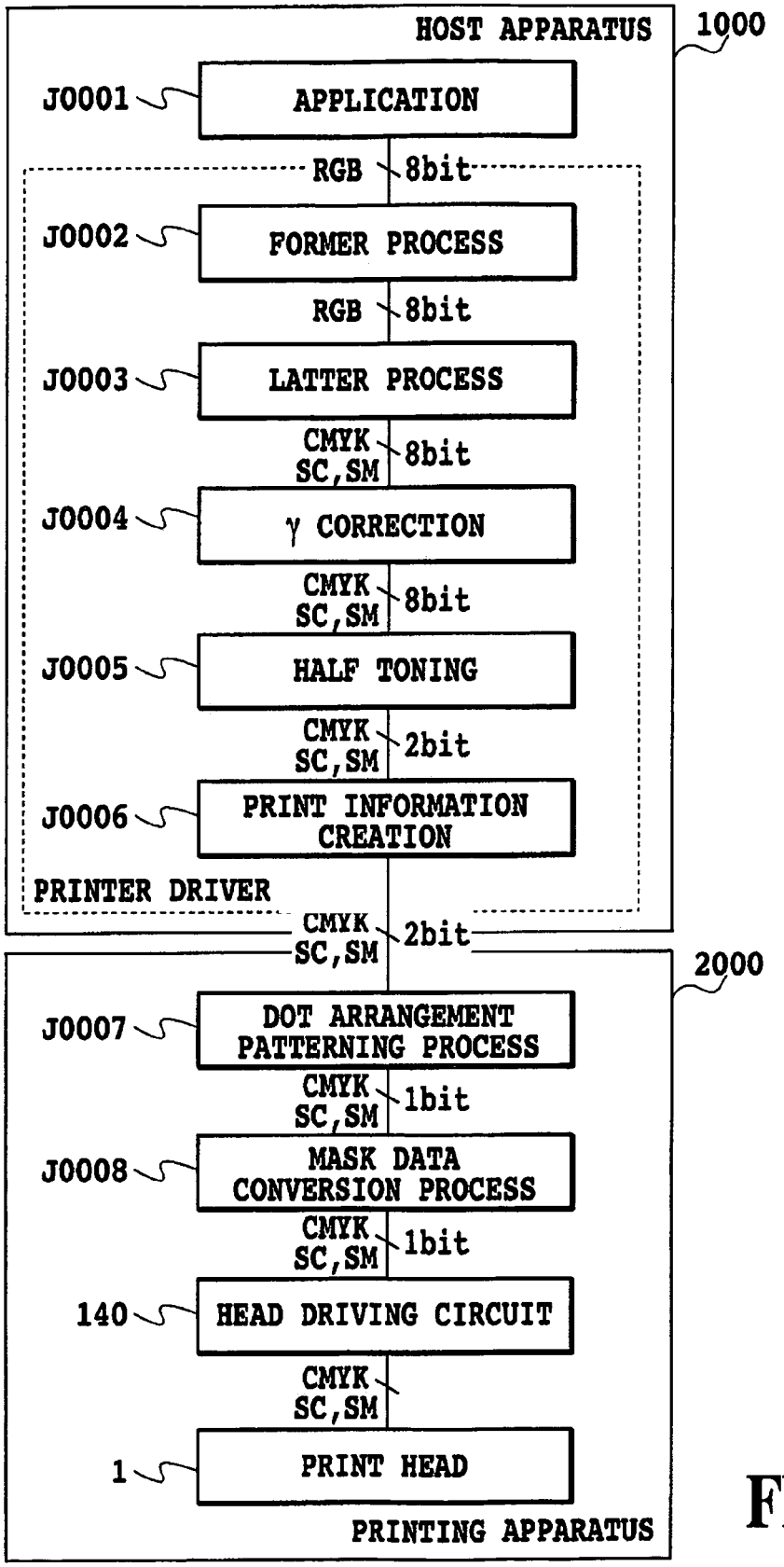
FIG. 8 is a block diagram of an image processing system of the printing system in FIG. 6.

FIG. 8 is a functional block diagram showing, along the flow of data, a printing system to which the present invention is applied by way of example. The printing apparatus 2000 of the present embodiment executes printing using for color inks, cyan, magenta, yellow, and black inks as previously described.

Programs operated by the operating system of the host apparatus 1000 include an application and a printer driver. An application J1001 executes a process of creating print data printed by the printing apparatus 2000. This print data or data not subjected to the relevant edition or the like yet can be loaded into the host apparatus 1000 in personal computer (PC) form via various media. The host apparatus 1000 in PC form in the present example can load, via a CF card, image data in, for example, JPEG format obtained with a digital camera. The host apparatus 1000 can also load image data in, for example, TIFF format read via a scanner and image data stored in a CD-ROM. The host apparatus 1000 can further load data on the WEB via the Internet. The loaded data is displayed on a monitor of the host apparatus 1000 and then subjected to edition, modification, or the like via the application J0001. Thus, for example, print data R, G, and B in conformity with the sRGB standards is created. The print data is delivered to the printer driver in accordance with a print instruction.

The printer driver of the present embodiment has processing sections for a former process J0002, a latter process J0003, γ correction J1004, half toning J0005, and print data creation J0006. The former process J0002 maps a gamut.

The former process J0002 of the present embodiment uses a three-dimensional LUT and an interpolation calculation to convert 8-bit image data R, G, and B into data R, G, and B in a gamut for the printing apparatus 2000. The three-dimensional LUT is a lookup table containing the relationship on the basis of which a gamut reproduced using the image data R, G, and B in conformity with the sRGB standards is mapped into a gamut reproduced by the printing apparatus 2000 of the print system.

The latter process J0003 obtains, on the basis of the data R, G, and B mapped into the gamut by the former process J0002, decomposed data for each of the inks that reproduce the colors expressed by the data. In the present example, decomposed data is provided for each of the yellow, magenta, cyan, and black ink colors, and for the cyan and magenta ink colors, decomposed data is provided for each dot size. That is, decomposed data Y, M, C, K, SC, and SM are obtained. The decomposed data Y, M, C, and K are for larger dots formed by the yellow, magenta, cyan, and black inks as described later. The decomposed data SC and SM are for smaller dots formed by the cyan and magenta inks as described later. The latter process J0003 of the present embodiment uses a three-dimensional LUT and an interpolation calculation similarly to the former process J0002.

The γ correction J0004 executes a gray scale value conversion on each of the decomposed data for each ink color and for each dot size which has been obtained by the latter process J0003. Specifically, the γ correction J0004 uses a one-dimensional LUT corresponding to the gray scale characteristics of the color inks used in the printing apparatus 2000. The γ correction J0004 thus converts the decomposed data corresponding to the ink colors and dot sizes so that the resulting data are linearly associated with the gray scale characteristics of the printing apparatus 2000.

The half toning J0005 quantizes each of the 8-bit decomposed data Y, M, C, K, SC, and SM into 2-bit data. The present embodiment uses an error diffusion method to convert the 8-bit data into the 2-bit data, which is index data indicating an arrangement pattern for a dot arrangement patterning process executed by the printing apparatus 2000 as described later. The print information creation process J0006 adds print control information to the print data containing the 2-bit index data to create print information.

The processes for the application and printer driver are executed by the CPU 1001 (see FIG. 6) in accordance with the programs for the application and printer driver. The programs are read from the ROM 1002 or the external storage device 1007 such as a hard disk. The RAM 1003 is used as a work area in which the processes are executed in accordance with the read programs.

For data processing, the printing apparatus 2000 executes a dot arrangement patterning process J0007 and a mask data converting process J0008. The dot arrangement patterning process J0007 arranges dots in accordance with a dot arrangement pattern corresponding to 2-bit index data (gray scale value information) as print data, for each pixel corresponding to an actual print image. A dot arrangement pattern is thus assigned to each pixel expressed by the 2-bit data; the dot arrangement pattern corresponds to the gray scale value of that pixel. This determines dot on or off, that is, whether or not a dot is formed, for each of a plurality of areas in the pixel. In other words, ejection data "1" or "0" is placed in each of the areas in each pixel.

The 1-bit ejection data thus obtained is masked by the mask data conversion process J0008. That is to say, ejection data is generated for each printing scan of the print head 1. In multipass printing that completes the print image in a predetermined area by plural scans of the print head 1, a mask corresponding to each of the scans is used to generate ejection data for that scan. The ejection data Y, M, C, K, SC, and SM for each scan are sent to the head driving circuit (head driver) 140 at the right time. The print head 1 is thus driven on the basis of the ejection data to eject the ink.

The dot arrangement patterning process J0007 and mask data conversion process J0008 in the printing apparatus 2000 are executed using a dedicated hardware circuit under the control of the CPU 101 (see FIG. 7), constituting the control section of the printing apparatus 2000. These processes may be executed by the CPU 101 in accordance with the corresponding programs or by, for example, the printer driver in the host apparatus in personal computer (PC) form. As is also apparent from the description below, the present invention is applicable regardless of the manners of these processes.

The "pixel" as used in the present specification refers to minimum unit which can be expressed by gray scales and which is the object of image processing (former process, latter process, γ correction, and half toning, described above) executed on multivalued data of plural bits. In the half toning process, one pixel corresponds to a pattern composed of m×n (for example, 2×2) frames. Each of the frames in one pixel is defined as an "area". The area is the minimum unit for which dot on or off is defined. In connection with this, the "image data" in the former process, latter process, and γ correction refers to a set of pixels to be processed. In the present embodiment, each pixel corresponds to data containing an 8-bit gray scale value. The "pixel data" in the half toning corresponds to the image data itself to be processed. The half toning according to the present embodiment converts the pixel data containing the 8-bit gray scale value into pixel data (index data) containing a 2-bit gray scale value.

(Air Current Control)

FIGS. 9, 10, 11A, and 11B are diagrams illustrating a technique for controlling air currents depending on the moving speed of the print head 1. Description will be given of an example of what is called 4-pass printing in which an image to be printed in a predetermined area on the print medium is completed by four scans of the print head 1.

Figure 9:
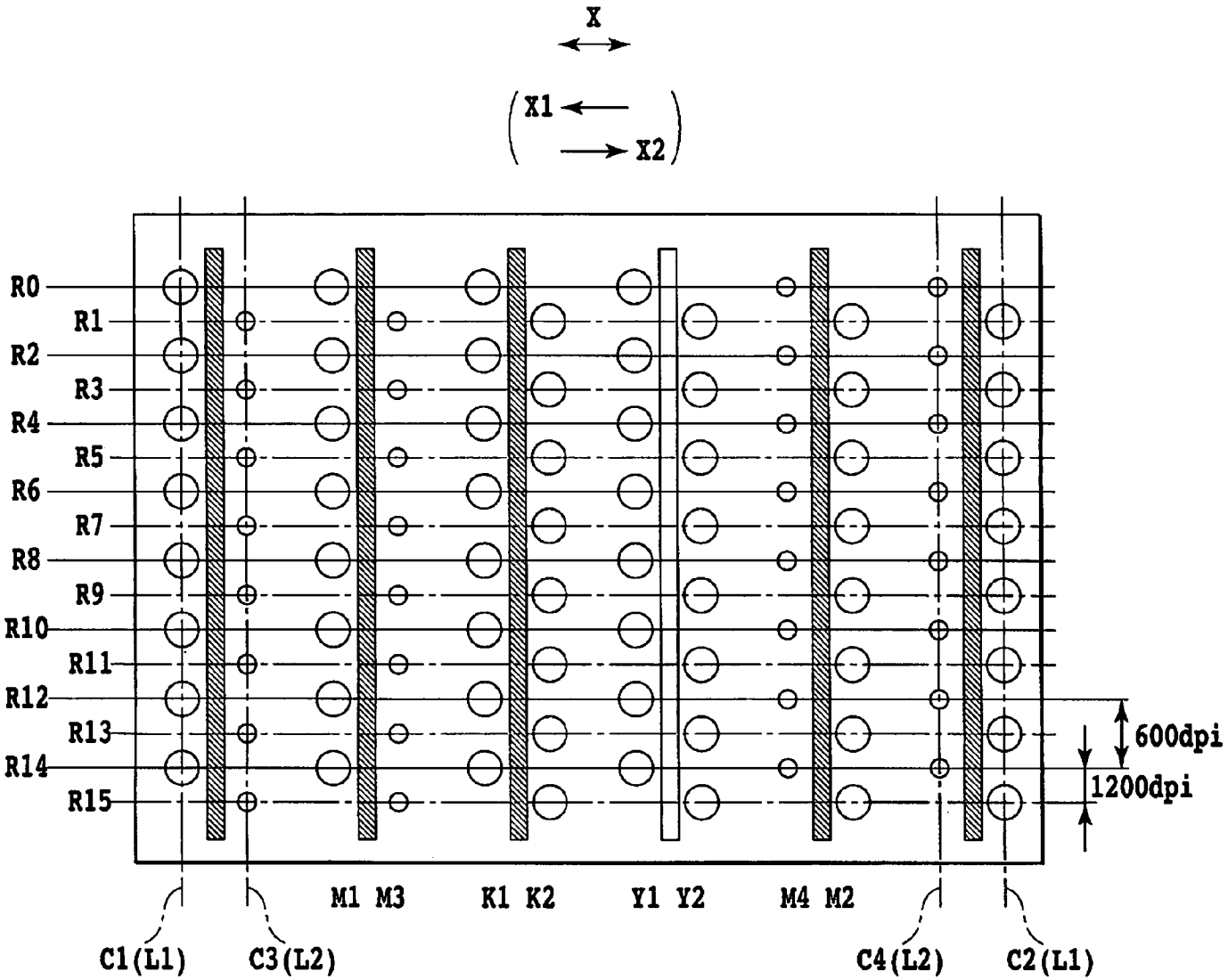
FIG. 9 is a diagram illustrating the configuration of nozzles in a print head used in the inkjet printing apparatus in FIG. 4.

FIG. 9 is a diagram illustrating the print head used in the present example. Nozzle arrays are formed in the print head to eject cyan (C), magenta (M), yellow (Y), and black (K) inks. The nozzle arrays from which cyan ink is ejected include nozzle arrays C1 and C2 for forming larger dots and nozzle arrays C3 and C4 for forming smaller dots. These nozzle arrays are symmetrically arranged in the main scanning direction. The nozzle arrays C1 and C3 are adjacent to each other across a common liquid chamber. The nozzle arrays C2 and C4 are adjacent to each other across a common liquid chamber. Similarly, the nozzle arrays from which magenta ink is ejected include nozzle arrays M1 and M2 for forming larger dots and nozzle arrays M3 and M4 for forming smaller dots. The nozzle arrays from which yellow ink is ejected include nozzle arrays Y1 and Y2 for forming larger dots. Similarly, the nozzle arrays from which black ink is ejected include nozzle arrays K1 and K2 for forming larger dots.

This print head can execute bidirectional printing in the main scanning direction shown by arrow X (X1 and X2) to print colored images. The arrow X1 is hereinafter referred to as a forward direction. The arrow X2 is hereinafter referred to as a backward direction. In this bidirectional printing, for example, the nozzle arrays C1, C3, M1, M3, K1, K2, Y1, and Y2 are used for forward printing, whereas the nozzle arrays C2, C4, M2, M4, K1, K2, Y1, and Y2 are used for backward printing. Thus, in the forward and backward printing operations, ink ejecting orders can be matched.

In the present example, all the nozzle arrays are used for each of the forward and backward printing operations. This enables an increase in printing speed. In this case, a substantially equal amount of print data is allocated to the pair of nozzle arrays (pair of larger-dot forming nozzle arrays or pair of smaller-dot forming nozzle arrays) from which droplets of the same color ink are ejected (distribution process) so as to prevent the print data from being biased toward one of the paired nozzle arrays. The paired nozzle arrays are thus equally used to uniformly distribute portions with different ink ejecting orders. This enables possible color unevenness to be suppressed and burdens on the ejection heaters in the nozzles to be distributed. For example, larger-dot forming print data that causes a relatively large amount of cyan ink to be ejected is expanded so as to be distributed evenly to the nozzle arrays C1 and C2. Smaller-dot forming print data that causes a relatively small amount of cyan ink to be ejected is expanded so as to be distributed evenly to the nozzle arrays C3 and C4.

In the present example, the larger-dot forming nozzle array is referred to as a first nozzle array L1. The smaller-dot forming nozzle array is referred to as a second nozzle array L2. A shorter distance between the nozzle arrays increases the level of adverse effect of air currents between the nozzles. Thus, air currents exert a higher level of adverse effect between the nozzle arrays disposed across the common liquid chamber. A higher level of adverse effect of air currents results from the nozzle arrays with the smaller ink ejection amount, that is, the nozzle arrays from which smaller ink droplets with lower kinetic energy are ejected. Moreover, a higher moving speed of the print head increases the level of adverse effect of air currents.

Figure 10:
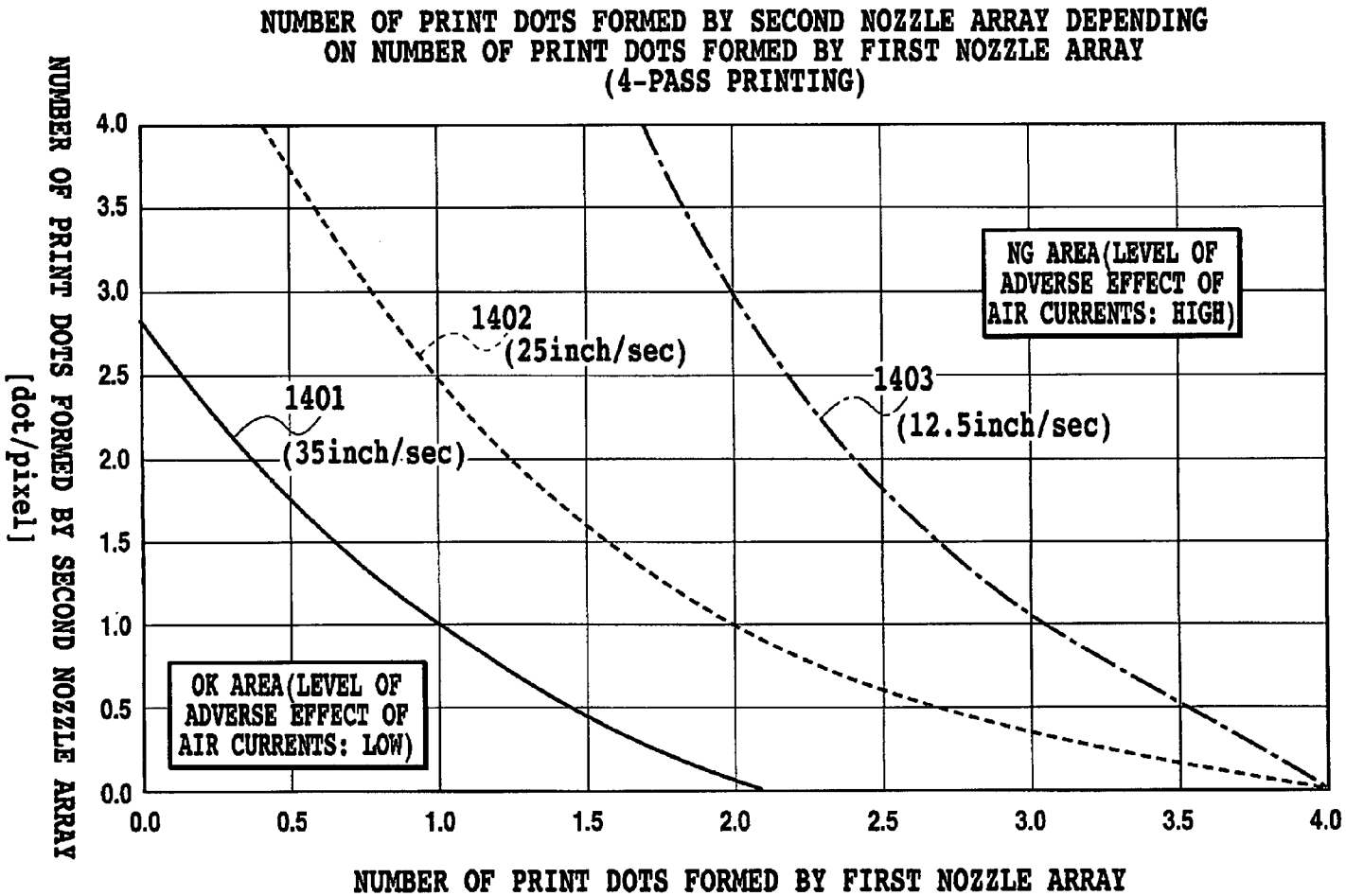
FIG. 10 is a diagram illustrating an air current control line experimentally obtained using the printing system in FIG. 6.

In the present example, air current control lines 1401, 1402, and 1403 were experimentally obtained as shown in FIG. 10; in 4-pass printing, the print head moves at a varying speed, the air current control lines 1401, 1402, and 1403 are used to suppress the adverse effect of air currents between the first nozzle array L1 and second nozzle array L2.

Figure 11B:
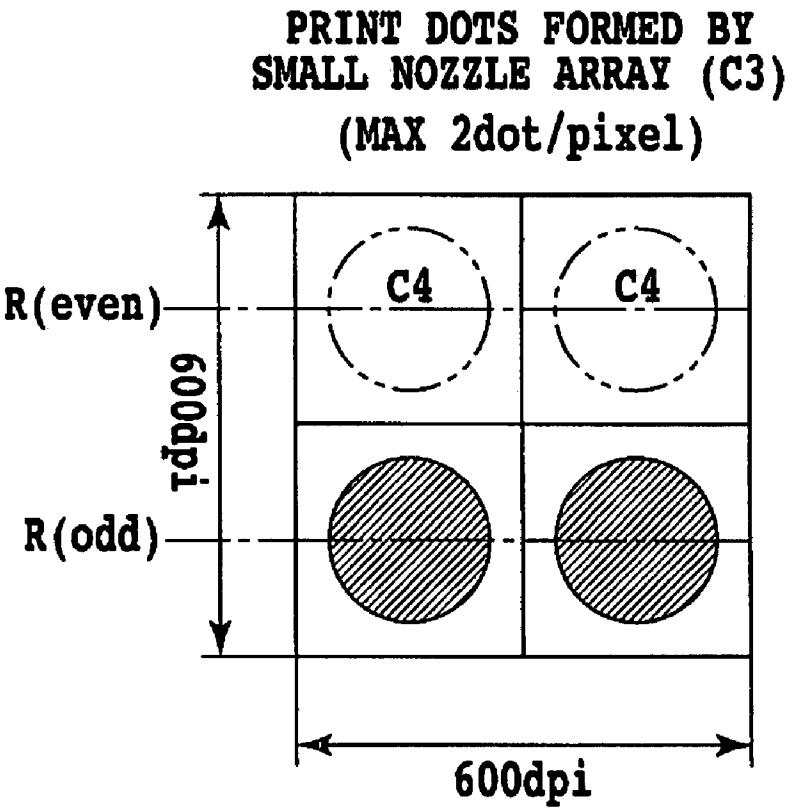
FIG. 11B is a diagram of a dot pattern formed using a small nozzle array in the print head in FIG. 9.
Figure 11A:
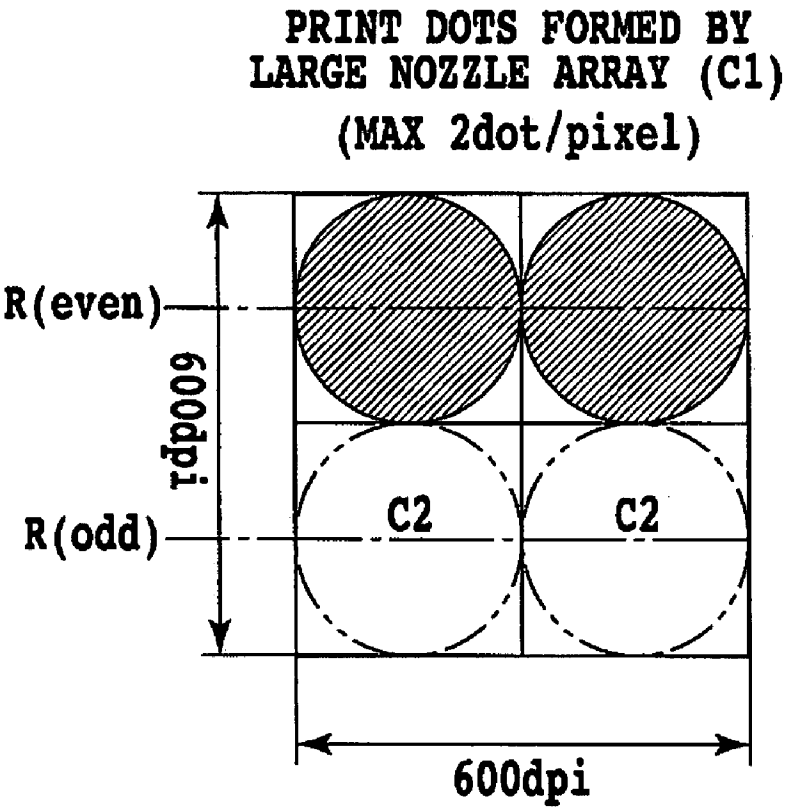
FIG. 11A is a diagram of a dot pattern formed using a large nozzle array in the print head in FIG. 9.

In FIG. 10, both the axes of ordinate and abscissa indicate the number of dots formed per pixel. As shown in FIG. 9, for each ink color, one larger-dot forming nozzle is located on the same raster (R0 to R15). Similarly, for each ink color, one smaller-dot forming nozzle is located on the same raster (R0 to R15). Thus, for example, the maximum number of larger dots formed within one pixel via the nozzle array C1 is two on an even-numbered raster as shown in FIG. 11A. The maximum number of smaller dots formed within one pixel via the nozzle array C3 is two on an odd-numbered raster as shown in FIG. 11B. Accordingly, for the cyan ink ejecting nozzle arrays, the axis of abscissa in FIG. 10 indicates the total number (maximum number: 4) of dots formed within one pixel via the nozzle arrays C1 and C2, constituting the first nozzle array L1. The axis of ordinate in FIG. 10 indicates the total number (maximum number: 4) of dots formed within one pixel via the nozzle arrays C3 and C4, constituting the second nozzle array L2. Larger-dot forming print data is evenly allocated to the nozzle arrays C1 and C2. Smaller-dot forming print data is evenly allocated to the nozzle arrays C3 and C4.

Each of the air current control lines 1401, 1402, and 1403 indicated the ratio of the number of dots formed within one pixel via the first nozzle array to the number of dots formed within one pixel by the second nozzle array.

First, on the basis of the air current control line 1401, the number of dots formed per pixel via the first and second nozzle arrays will be considered. The area above the air current control line 1401 is an NG area which involves a higher level of adverse effect of air currents resulting from ink ejection and which prevents the formation of high-grade images. On the other hand, an area with a smaller total number of dots formed via both the first and second nozzle arrays, that is, the area below the air current control line 1401, is an OK area which involves a lower level of adverse effect of air currents resulting from ink ejection and which enables the formation of high-grade images. Printing control requires such print data as sets the number of dots formed via both the first and second nozzle arrays, at a value within the OK area.

The three air current control lines 1401, 1402, and 1403 indicate that the print head moves at a varying speed in 4-pass printing. When the print head moves at a speed of 35 [inches/second], print data is generated such that dots are formed within the OK area for the air current control line 1401. An image is then printed on the basis of the generated print data. When the print head moves at a speed of 25 [inches/second], print data is generated such that dots are formed within the OK area for the air current control line 1402. An image is then printed on the basis of the generated print data. When the print head moves at a speed of 12.5 [inches/second], print data is generated such that dots are formed within the OK area for the air current control line 1403. An image is then printed on the basis of the generated print data. A lower moving speed of the print head reduces the level of adverse effect of air currents. This locates the air current control line at a higher position to widen the OK area. Thus, print data is generated such that dots are formed within the OK area corresponding to the moving speed of the print head. An image is then printed on the basis of the generated print data. This enables printing control to be performed without being affected by air currents, regardless of moving speed of the print head.

Figure 12:
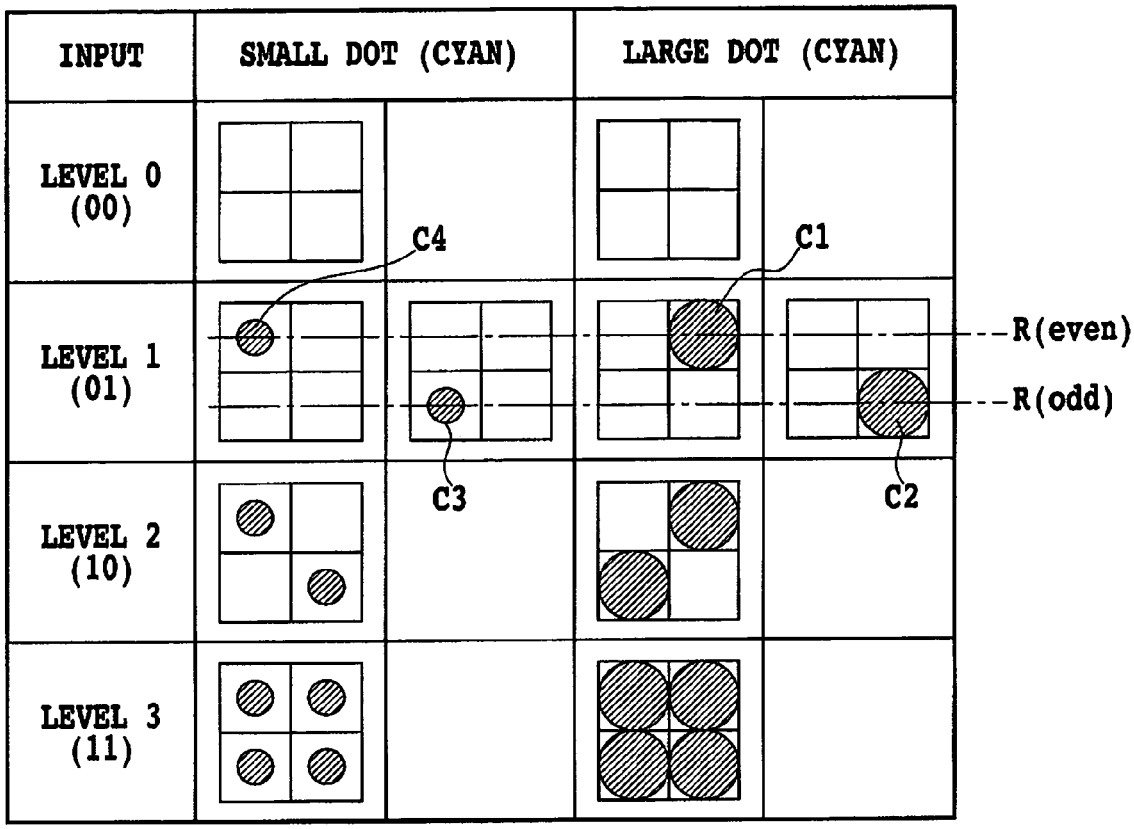
FIG. 12 is a diagram illustrating the format of print data in the printing system in FIG. 6.

FIG. 12 is a diagram illustrating an example of configuration of larger- and smaller-dot forming print data. Each of these data is in an independent 2-bit data format. When the larger-dot forming print data is at a level 1, one larger dot is formed in one pixel. Similarly, when the smaller-dot forming print data is at a level 1, one smaller dot is formed in one pixel. In this case, the former level 1 print data are evenly distributed to the pair of larger-dot forming nozzle arrays (for, for example, the cyan ink, the nozzle arrays C1 and C2). The latter level 1 print data are evenly distributed to the pair of smaller-dot forming nozzle arrays (for, for example, the cyan ink, the nozzle arrays C3 and C4).

Figure 13:
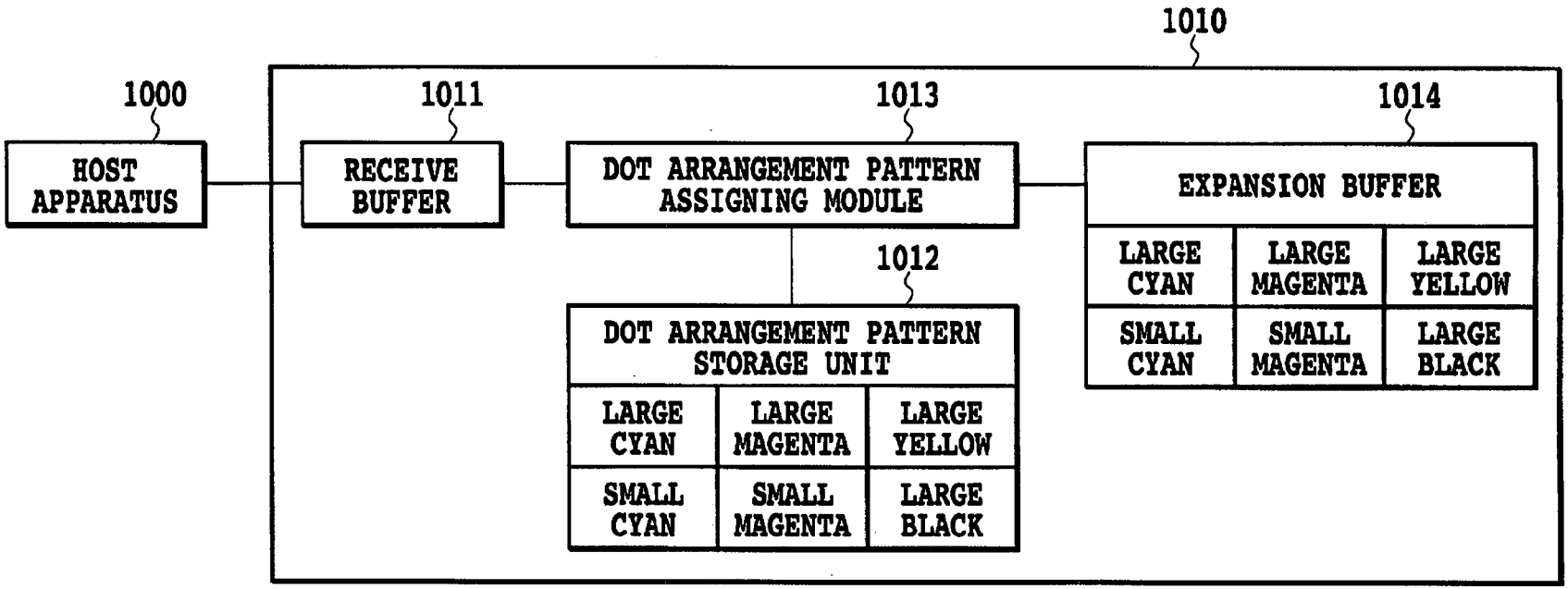
FIG. 13 is a block diagram of a printing control section in FIG. 6.

FIG. 13 is a block diagram illustrating such a process of distributing print data.

In the printing control section 1010 of the inkjet printing apparatus 2000, a receive buffer 1011 receives 2-bit quantized print data from the host apparatus 1000. A dot arrangement pattern storage unit 1012 stores dot arrangement patterns. A dot arrangement pattern assigning module 1013 executes the dot arrangement patterning process in FIG. 8. The dot arrangement pattern assigning module 1013 assigns a dot arrangement pattern stored in the storage unit 1012, to the print data in the receive buffer 1011. An expansion buffer (print buffer) 1014 expands the print data on the basis of the dot assignment pattern assigned by the module 1013. The module 1013 is a software module stored in the ROM 103 (see FIG. 7) and executed by the CPU 101 (see FIG. 7). The receive buffer 1011, storage unit 1012, and expansion buffer 1014 are provided in a predetermined address region in a DRAM.

Numbered dot arrangement patterns are prestored in the storage unit 1002. The dot arrangement patterns can be composed of print data for the differently sized dots (quantized data at levels 0 to 3) as shown in FIG. 12. One of the patterns is selectively expanded into the expansion buffer 1004. Dots are then formed in accordance with the expanded pattern. In FIG. 13, the larger cyan refers to a pattern for larger-dot formation with the cyan ink, and the smaller cyan refers to a pattern for smaller-dot formation with the cyan ink. The larger magenta refers to a pattern for larger-dot formation with the magenta ink, and the smaller magenta refers to a pattern for smaller-dot formation with the magenta ink. The larger yellow refers to a pattern for larger-dot formation with the yellow ink, and the larger black refers to a pattern for smaller-dot formation with the black ink.

Figure 14:
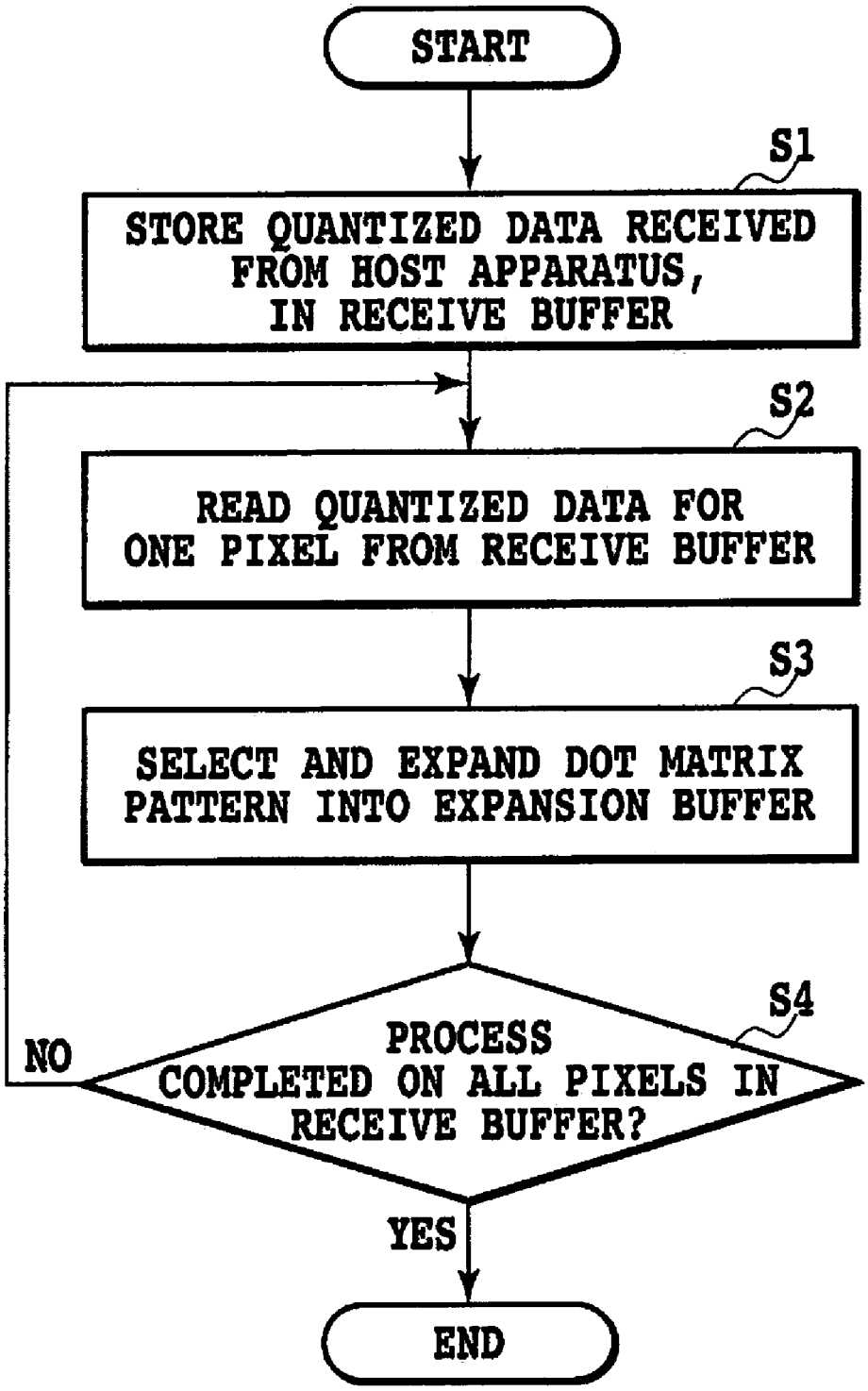
FIG. 14 is a flowchart illustrating a data expanding process executed by an arrangement pattern assigning module in FIG. 13.

FIG. 14 is a flowchart illustrating a data expanding process executed by the dot arrangement pattern assigning module 1003.

First, print data (2-bit quantized data) transferred by the host apparatus 1000 is received and stored in the receive buffer 1001 (step S1). Then, print data for one pixel is read from the stored print data (step S2). A dot arrangement pattern corresponding to the level (0 to 3) of the read print data is selected and expanded into an expansion buffer 1005 (step S3). If two dot arrangement patterns are available for the same level of print data, one of them is selected and expanded. In this case, the two dot arrangement patterns for the same level are alternately assigned to the nozzle arrays. In the present example, when smaller dots of the cyan ink are to be formed using the level 1 print data, two patterns such as those shown in FIG. 12 are alternately evenly distributed to the nozzle arrays C3 and C4. The process then determines whether or not all the pixels in the print data stored in the receive buffer 1001 have been expanded into an expansion buffer 1004 (step S4). If not all the pixels have been expanded, the process returns to step S2. If all the pixels have been expanded, the data expansion process is ended.

(Generation of Print Data)

FIGS. 15A, 15B, 15C, 16A, 16B, and 16C are diagrams specifically illustrating a method of generating print data corresponding to the larger- and smaller-dot forming nozzle arrays as shown in FIG. 9.

Figure 15A:
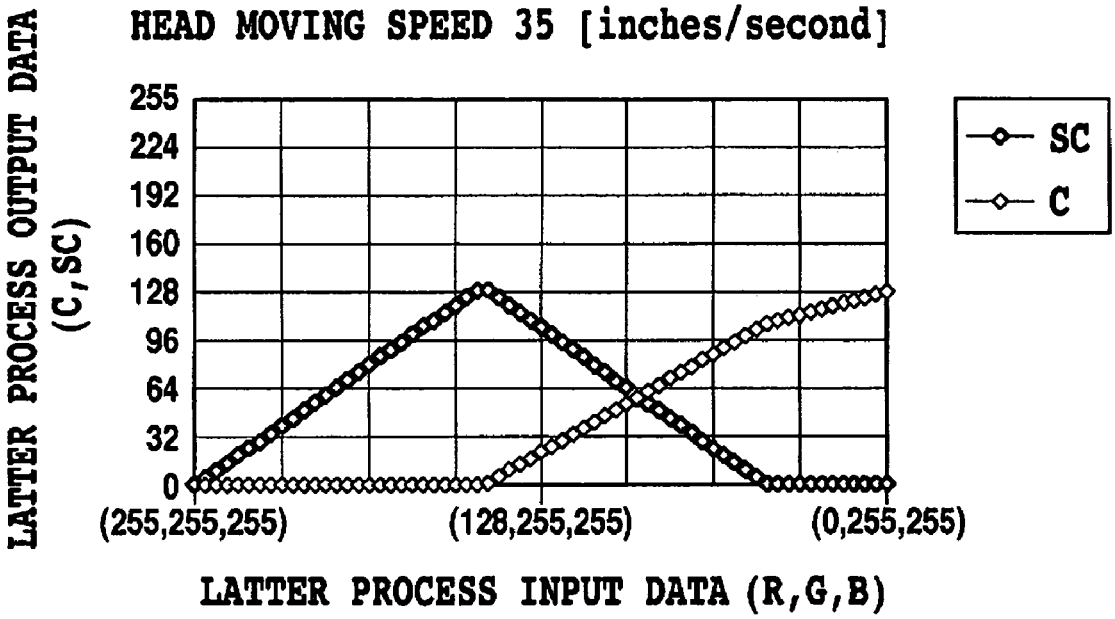
FIG. 15A is a diagram illustrating an example of print data converted by the latter process in FIG. 8 when the print head moves at a speed of 35 [inches/second]
Figure 15B:
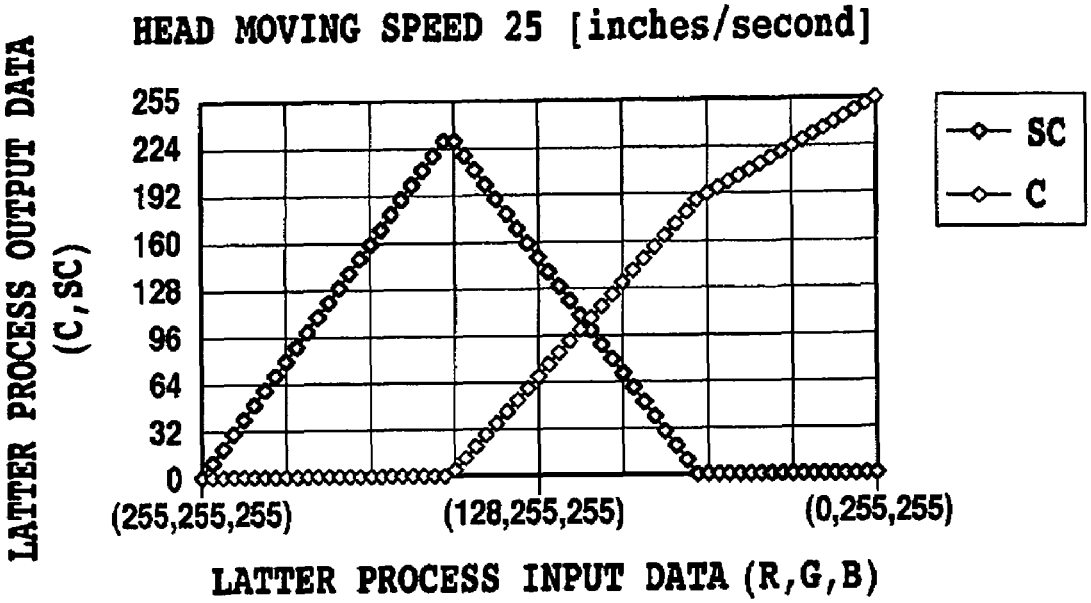
FIG. 15B is a diagram illustrating an example of print data converted by the latter process in FIG. 8 when the print head moves at a speed of 25 [inches/second]
Figure 15C:
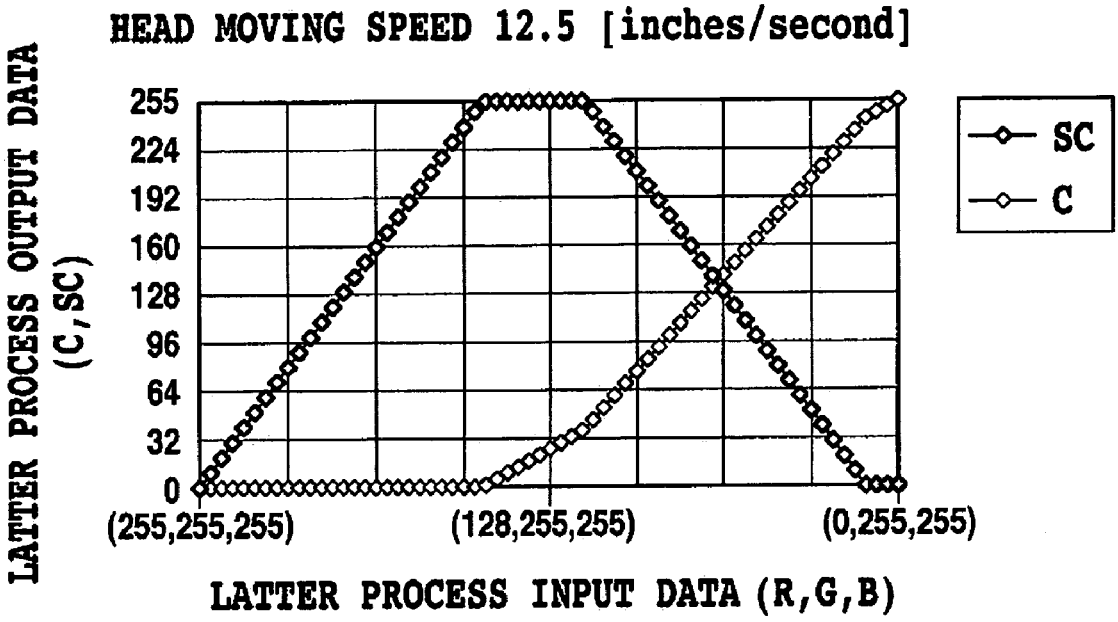
FIG. 15C is a diagram illustrating an example of print data converted by the latter process in FIG. 8 when the print head moves at a speed of 12.5 [inches/second]

The present embodiment generates print data within the OK area for the air current control line while maintaining the gray scale levels in the print image. In the present example, print data corresponding to each nozzle array is finally generated via a series of data processes including the data conversion process in the latter process J0003 (see FIG. 8) as shown in FIGS. 15A, 15B, and 15C. As previously described, the latter process J0003 accepts and converts 8-bit luminance data (latter process input data) for each of R, G, and B into 8-bit color decomposition data C, M, Y, K, SC, and SM (latter process output data).

FIGS. 15A, 15B, and 15C are diagrams representatively describing a method of generating C data for larger-dot formation with the cyan ink and SC data for smaller-dot formation with the cyan ink. Larger and smaller dots of the cyan ink are formed using the adjacent nozzle arrays (nozzle arrays C1 (L1) and C3 (L2) or C2 (L1) and C4 (L2)). In FIGS. 15A, 15B, and 15C, of the R, G, and B data each of 8 bits, the G and B data are fixed at (255) for convenience. Accordingly, the axis of abscissa in these figures, that is, the latter process input data (R, G, and B) for R, G, and B, indicates a variation in R data (variation in hue) when the G and B data are (255). In short, the axis of abscissa indicates the range from white (255, 255, 255) to cyan (0, 255, 255), which has the highest concentration. On the other hand, the axis of ordinate indicates the value of the 8-bit latter process output data (C, SC). The manner of data conversion in the latter process J0003 varies depending on the moving speed of the print head. In the present example, when the print head moves at a speed of 35, 25, and 12.5 [inches/second], data conversion is carried out as shown in FIGS. 15A, 15B, and 15C, respectively.

Figure 16A:
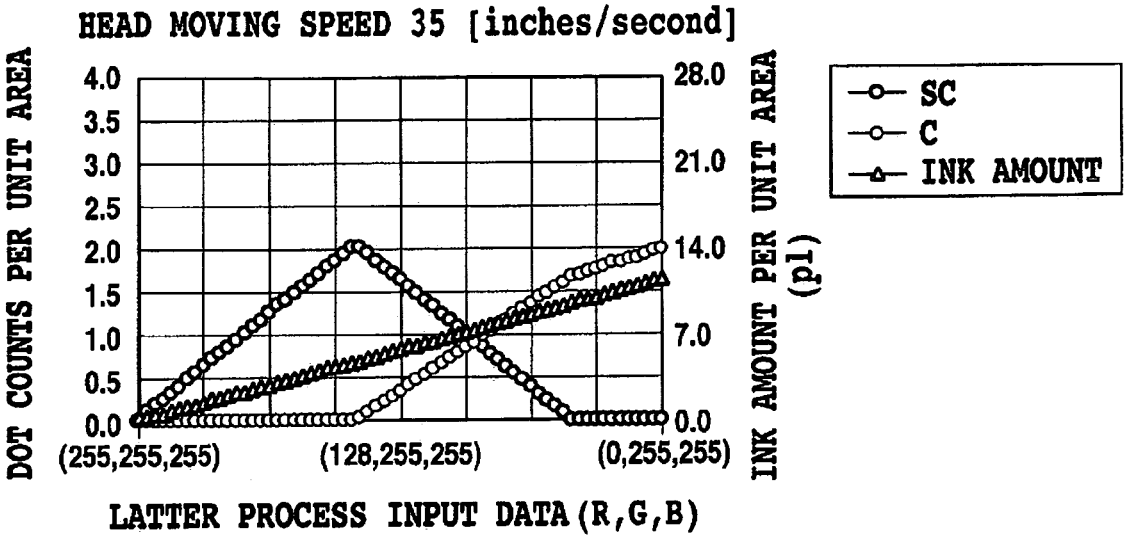
FIG. 16A is a diagram illustrating the relationship between the print data in FIG. 15A and ink ejection amount.

FIG. 15A is a diagram of a latter process executed if a print mode is specified in which the print head moves at the maximum speed of 35 [inches/second]. As shown in FIG. 15A, if the latter process input data is within the range from about (255, 255, 255) to (160, 255, 255), only the SC data is output so as to form an image only with smaller cyan dots. On this occasion, SC data is output so as to gradually increase the number of smaller cyan dots formed. When the latter process input data is (160, 255, 255), the SC data has nearly the maximum output value of 128. At the maximum output value of 128, the number of smaller dots formed is "2" as shown in FIG. 16A. However, the value "2" is located below the air current control line 1401 in FIG. 10. Therefore, the air current problem is avoided.

Then, if the latter process input data is within the range from about (160, 255, 255) to (44, 255, 255) in FIG. 15A, both C and SC data are output so as to form an image with larger and smaller cyan dots. In this case, the C and CS data are output so as to gradually reduce the number of smaller cyan dots formed, while gradually increasing the number of larger cyan dots formed. Specifically, when the latter process input data is (92, 255, 255), both the C and SC data have an output value of about 64 and allow "1" dot to be formed (see FIG. 16A). When the latter process input data is (44, 255, 255), the SC data has an output value of 0, while the C data has an output value of about 100. At this time, the number of smaller dots formed is "0", while the number of larger dots formed is "1.7" (see FIG. 16A). Both when the number of smaller dots formed and the number of larger dots formed are both "1" and when the number of smaller dots formed is 0, whereas the number of larger dots formed is "1.7", all these values are located below the air current control line 1401 in FIG. 10. Therefore, the air current problem is avoided.

Finally, if the latter process input data is within the range from about (44, 255, 255) to (0, 255, 255) in FIG. 15A, only the C data is output so as to form an image only with larger cyan dots. In this case, the C data is output so as to gradually increase the number of larger cyan dots formed. When the latter process input data is (0, 255, 255), the C data has nearly the maximum output value of 128. At the maximum output value of 128, the number of smaller dots formed is "2" as shown in FIG. 16A. The value "2" is located below the air current control line 1401 in FIG. 10. Therefore, the air current problem is avoided.

Thus, in FIG. 15A, involving the highest speed of the print head, the adverse effect of air currents is at a relatively high level. Accordingly, the numbers of larger and smaller dots formed are strictly limited. Specifically, print data corresponding to the larger- and smaller-dot nozzle arrays are generated so that the numbers of larger and smaller dots formed are within the narrow OK area below the print control line 1401 in FIG. 10. This suppresses the adverse effect of air currents when the print head moves at the highest speed.

In contrast, FIG. 15C is a diagram illustrating a latter process executed if a print mode is specified in which the print head moves at the lowest speed of 12.5 [inches/second]. As shown in FIG. 15C, the range of latter process input data allowing the formation of smaller dots is wider than that in FIG. 15A. In other words, this print mode involves a wider gray scale range within which smaller dots can be used and is thus advantageous for reducing the granularity of a highlight portion. The maximum numbers of smaller and larger dots formed in FIG. 15C are larger than those in FIG. 15A. Thus, the print mode in FIG. 15C provides a wider expressible density range.

The total number of larger and smaller dots mixed in a unit area in FIG. 15C is larger than that in FIG. 15A. A higher level of adverse effect of air currents enhances the need to limit the number of larger and smaller dots mixed. However, since FIG. 15C involves a lower level of adverse effect of air currents than FIG. 15A, the above limitation is light. This enables an increase in the number of larger and smaller dots mixed. A wider allowable range of the maximum number of larger and smaller dots mixed allows a design such that a relatively large number of small dots are ejected when larger dots start to be mixed with smaller dots. This enables the granularity of larger dots to be reduced in a halftone area. Further, in the halftone area and high-density area, biased ejection of ink droplets is likely to result in stripes in the conveying direction of the print medium. However, increasing the number of larger and smaller dots mixed makes it possible to increase the number of nozzles involved in printing in this density area. This enables a reduction in the adverse effect of the biased ejection. In FIG. 15C, print data corresponding to the larger- and smaller-dot nozzle arrays are generated so that the numbers of larger and smaller dots formed are within the OK area below the print control line 1403 in FIG. 10.

Specifically, if the latter process input data is within the range from about (255, 255, 255) to (160, 255, 255) in FIG. 15C, the output value of the SC data is gradually increased. When the latter process input data is (160, 255, 255), the SC data has nearly the maximum output value of 256. At the maximum output value of 256, the number of smaller dots formed is "4" as shown in FIG. 16C. However, the value "4" is located below the air current control line 1403 in FIG. 10. Therefore, the air current problem is avoided.

Then, if the latter process input data is within the range from about (160, 255, 255) to (116, 255, 255) in FIG. 15C, the output value of the C data is gradually increased with the SC data maintained at nearly the maximum value of 256. When the latter process input data is (116, 255, 255), the number of smaller dots formed is "4", while the number of larger dots formed is "1" as shown in FIG. 16C. This combination of dot numbers is located below the air current control line 1403 in FIG. 10. Therefore, the air current problem is avoided.

Finally, if the latter process input data is within the range from about (116, 255, 255) to (0, 255, 255) in FIG. 15C, the output value of the C data is gradually increased, while gradually reducing the output value of the SC data. When the latter process input data is (64, 255, 255), both the SC and C data have an output value of about 128. At this time, both the number of smaller dots formed and the number of larger dots formed are "2" (see FIG. 16C). This combination of dot numbers is located below the air current control line 1403 in FIG. 10. Therefore, the air current problem is avoided. Further, when the latter process input data is (0, 255, 255), the C data has nearly the maximum output value of 255. At the maximum output value of 255, the number of larger dots formed is "4" as shown in FIG. 16C. The value "4" is located below the air current control line 1403 in FIG. 10. Therefore, the air current problem is avoided.

Thus, in FIG. 15C, involving the lowest speed of the print head, the adverse effect of air currents is at a relatively low level. Accordingly, the limitation on the numbers of larger and smaller dots formed is more lenient than that in FIG. 15A. Specifically, print data corresponding to the larger- and smaller-dot nozzle arrays are generated so that the numbers of larger and smaller dots formed are within the wide OK area below the print control line 1403 in FIG. 10. This suppresses the adverse effect of air currents when the print head moves at the low speed.

When the print head moves at a speed of 25 [inches/second], as shown in FIG. 15B, the range of the latter process input data within which smaller dots can be formed is wider than that in FIG. 15A and narrower than that in FIG. 15C. Thus, the total number of smaller and larger dots mixed in the unit area is larger than that in FIG. 15A and smaller than that in FIG. 15C. In FIG. 15B, print data corresponding to the larger- and smaller-dot nozzle arrays are generated so that the numbers of larger and smaller dots formed are within the OK area below the print control line 1402 in FIG. 10.

The series of data conversion processes including the latter process J0003 are thus executed to generate print data. Then, as previously described, the print head ejects the ink on the basis of the print data to print an image on the print medium.

Figure 16B:
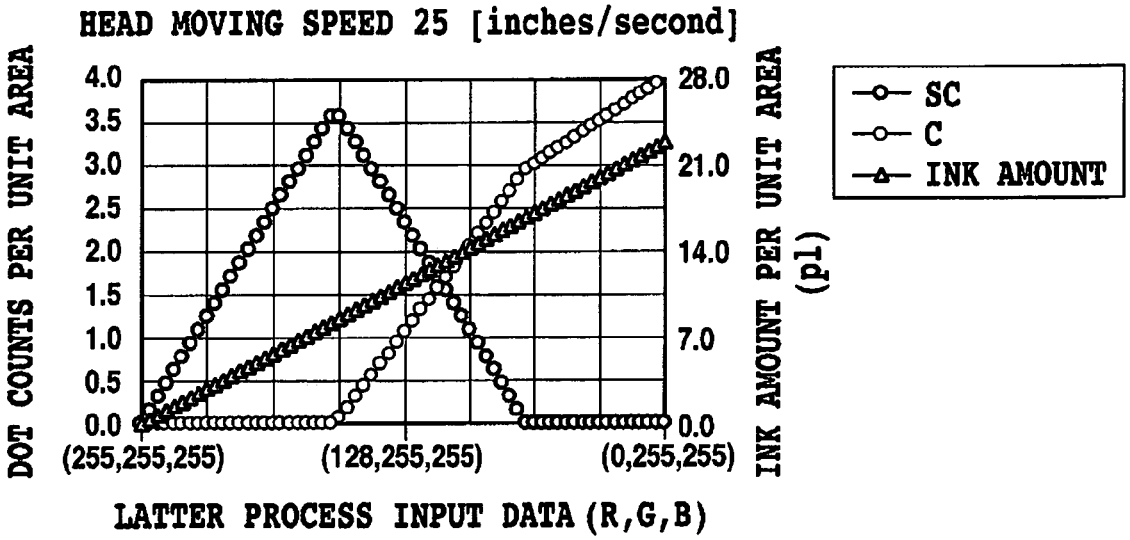
FIG. 16B is a diagram illustrating the relationship between the print data in FIG. 15B and the ink ejection amount.
Figure 16C:
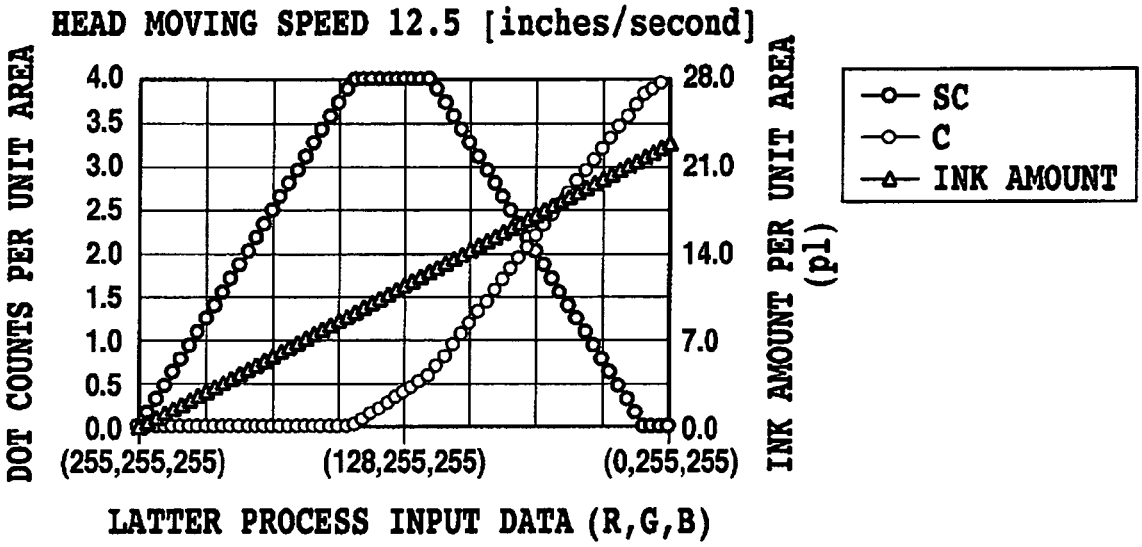
FIG. 16C is a diagram illustrating the relationship between the print data in FIG. 15C and the ink ejection amount.

FIGS. 16A, 16B, and 16C are diagrams illustrating larger and smaller dots formed on the print medium using the cyan ink on the basis of the print data generated by the series of data conversion processes including the one in FIGS. 15A, 15B, and 15C.

The axis of abscissa in these figures indicates the latter process input data (R, G, and B) in the latter process J1003 similarly to the axis of abscissa in FIGS. 15A, 15B, and 15C. The left axis of ordinate indicates the number of larger and smaller dots formed in the unit area on the print medium. The right axis of ordinate indicates the total amount [pl (picolitter)] of cyan ink ejected to the unit area, that is, the total amount of cyan ink applied to form larger and smaller dots.

The number of larger and smaller dots formed per unit area corresponds to the latter process output data in FIGS. 15A, 15B, and 15C (output values of the C and SC data), which vary with the moving speed of the print head. As a result, the total amount of cyan ink applied varies linearly with the latter process input data.

As is common to FIGS. 15A to 15C, when the latter process input data is in the low density area (for example, within the range from about (255, 255, 255) to (200, 255, 255)), an image is printed only with smaller dots taking the granularity of a highlight portion of the print image into account. The number of smaller dots formed is gradually increased with the value of the latter process input data to increase print density. When the value of the latter process input data is in or above a half tone level area, larger dots are efficiently formed in order to obtain the required print density. If an image is printed only with smaller dots, although depending on the number of passes in the multipass printing system, small ink droplets that form smaller dots may imprecisely impact the print medium, thus making the density of the print image uneven. Thus, in the half tone level area, smaller and larger dots are mixed together to form an image. In the half tone level area and the maximum density area, the printing ratio of the larger-dot forming nozzle array to the smaller-dot forming nozzle array is changed so that the number of larger dots formed is larger that that of smaller dots formed. This suppresses the adverse effect of air currents.

The present embodiment generates print data as described above, taking into account the adverse effect of air currents, the precision with which smaller ink droplets impact the print medium, and the granularity of the print image observed when larger dots start to be formed. Good images can be printed by thus generating print data taking the adverse effect of air currents which varies depending on the moving speed of the print head.

The present embodiment also uses the former process J1003 to convert input image data R, G, and B input image data into print data C, M, Y, K, SC, and SM so that the amount of ink ejected from adjacent nozzle rows per pixel (per unit area) is controlled depending on the moving speed of the print head. For example, tables are provided which associate I/O data with each moving speed of the print head as shown in FIGS. 15A, 15B, and 15C. Such a data conversion as described above can then be executed in the former process J0003 using these tables.

The adverse effect of air currents resulting from ink ejection can be suppressed by generating print data such that the number of dots formed via a plurality of adjacent nozzle arrays per unit area (in the above example, per pixel) is controlled depending on the moving speed of the print head, as described above. The adverse effect of air currents between adjacent nozzle arrays varies according to the moving speed of the print head. Thus, print data corresponding to the moving speed is generated. The amount of ink ejected from the nozzle arrays is then controlled on the basis of the print data. This makes it possible to optimally control printing with a plurality of nozzle arrays to print high-quality images. Controlling the amount of ink ejected from the adjacent nozzle arrays means controlling the ratio of the amounts of ink ejected from these nozzle arrays.

The above embodiment has been described in conjunction with 4-pass printing. However, the number of print passes in the present invention is not limited to "4". The number (N) of print passes in the present invention has only to be an integer. The present invention is applicable to various numbers of passes such as one pass, two passes, and eight passes.

In the description of the above embodiment, larger and smaller dots of the same color can be printed. However, the present invention is not limited to this aspect. For example, the present invention is applicable even if only one type of dots can be printed for the same color. In this case, at least two dot lines may be provided which eject the same color ink. Print data corresponding to the moving speed of the print head may then be generated for these nozzle arrays. The present invention is also applicable to the use of inks with similar colors (for example, light and dark cyan inks). In this case, the above relationship between larger and smaller dots may be applied to dark and light dots. Print data corresponding to the moving speed of the print head may then be generated for the dark and light ink nozzle arrays.

(Other Embodiments)

Print data is generated taking into account the opposite spacing (sheet distance) between the ejection opening surface of the print head and the print medium. This makes it possible to control the amount of ink ejected from adjacent nozzle arrays (the amount corresponds to the number of ink droplets ejected). A larger sheet distance increases the flying distance of ink droplets and lowers the flying speed of the ink droplets. This reduces the kinetic energy of the ink droplets, which become likely to be affected by air currents. Print data is thus generated such that the adverse effect of air currents is more strictly suppressed as the sheet distance increases. This makes it possible to control the amount of ink ejected from the adjacent nozzle arrays. For example, a head moving speed of 12.5 [inches/second] will be considered. In this case, data processing is executed so that as the sheet distance increases, the OK area for the air current control line 1403 in FIG. 10 is narrowed so that larger and smaller dots are formed within the narrow OK area.

If nozzle rows from which different inks are ejected are adjacent to each other like the nozzle arrays C3 and M1 in FIG. 9, print data is generated such that the adverse effect of air currents on the nozzle arrays C3 and M1 is suppressed. This makes it possible to control the amount of ink ejected from the nozzle arrays C3 and M1. In this case, print data may be generated such that the ink ejection amount is controlled to avoid the serious adverse effect of air currents on nozzle arrays from which smaller ink droplets are ejected and which are located behind the moving path of the print head.

If print data is generated such that during forward printing when the print head moves in the direction of arrow X1 in FIG. 9, the amount of ink ejected from the nozzle arrays C2 and C4 is controlled as previously described, print data may be generated, taking the presence of the nozzle array M2 into account, such that the amount of ink ejected from the nozzle array C4 adjacent to the nozzle array M2 is controlled. Print data may thus be generated such that the amount of ink ejected from adjacent nozzle arrays is controlled so as to suppress the adverse effect of air currents, regardless of the type of the ejected ink. In other words, the adverse effect of air currents can be suppressed by generating print data such that the amount of ink ejected per unit area (the amount corresponds to the number of ink droplets ejected) is controlled for the adjacent nozzle arrays.

Print data is generated taking the adverse effect of air currents into account not only if ink droplets of different sizes are ejected from the nozzle arrays but also if ink droplets of the same size are ejected from the nozzle arrays. This enables similar effects to be exerted.

According to the present invention, if an image is printed by specifying one of the plural print modes in which the print head moves at the different speeds, it is only necessary to be able to generate print data such that different amounts of ink are ejected from the plural nozzle arrays per unit area depending on the specified print mode. In other words, it is only necessary to be able to generate print data enabling the avoidance of the possible adverse effect of air currents, by the image process corresponding to one of the plural print modes in which the print head moves at the different speeds. Print data can be generated by converting input image data indicating a predetermined luminance level.

(Miscellaneous Matters)

The present invention may also carried out by directly or remotely supplying a system or apparatus with a software program that provides the functions of the above embodiments and allowing a computer in the system or apparatus to read and execute codes from the supplied program. The program may be replaced with anything that provides the functions of the program.

To allow the computer to execute the functions of the present invention, the program codes themselves installed in the computer also carry out the present invention. In other words, the claims of the present invention include the computer program itself that provides the functions of the present invention.

The program may be in an arbitrary form such as object codes, a program executed by an interpreter, or script data supplied to the OS as long as it provides the functions of the program.

Examples of storage media that supplies the program include a flexible disk, a hard disk, an optical disk, a magneto optical disk, an MO, a CD-ROM, a CD-R, a CD-RW, a magnetic tape, a nonvolatile memory card, a ROM, and a DVD (DVD-ROM or DVD-R).

The program may also be supplied by using a browser in a client computer to connect the computer to a home page on the Internet and downloading the computer program proper of the present invention or a compressed file including an automatic install function, from the home page into storage media such as a hard disk. The program may also be supplied by dividing the program codes constituting the program of the present invention into a plurality of files and downloading the respective files from different home pages. That is to say, the scope of the present invention includes a WWW server that allows program files to be downloaded to a plurality of users; the program files allow the computer to provide the functions of the present invention.

The present invention may also be carried out by encrypting the program of the present invention, storing the resulting program in storage media such as a CD-ROM, distributing the storage media to users, allowing users who meet predetermined conditions to download key information for decryption from a home page via the Internet, and using the key information to execute and install the encrypted program in the computer.

To execute the functions of the above embodiments, the computer need not necessarily execute the read program. The functions of the above embodiments may also be provided by allowing an OS or the like running on the computer to execute a part or all of the actual processing on the basis of an instruction from the program.

The functions of the above embodiments may also be provided by writing the program read from the storage media into a memory provided in an expanded board inserted into the computer or in an expanded unit connected to the computer and then allowing a CPU or the like provided in the expanded board or unit to execute a part or all of the actual processing on the basis of an instruction from the program.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a continuation application of PCT application No. PCT/JP2005/010563 under 37 Code of Federal Regulations § 1.53 (b) and the said PCT application claims the benefit of Japanese Patent Application No. 2004-171741, filed Jun. 9, 2004, which is hereby incorporated by reference herein in its entirety.

The invention claimed is:

1. An inkjet printing method for printing an image on a print medium by ejecting ink droplets from a print head on the basis of print data while moving the print head in a direction crossing a predetermined direction, the print head comprising at least a first nozzle array having a plurality of nozzles which are arranged in the predetermined direction and a second nozzle array having a plurality of nozzles which are arranged in the predetermined direction, a color of a first ink droplet ejected from the first nozzle array being the same color as a second ink droplet ejected from the second nozzle array and an amount of ink ejected in the first ink droplet from the first nozzle array being less than an amount ejected in the second ink droplet from the second nozzle array, the method comprising the steps of:

specifying one of a plurality of print modes including a first print mode in which the print head is moved at a first moving speed in order to print the image on the print medium and a second print mode in which the print head is moved at a second moving speed faster than the first moving speed in order to print the image on the print medium; and converting input image data into the print data corresponding to each of the first and second nozzle arrays so that the maximum number of first ink droplets ejected per unit area of the print medium is smaller when the second print mode is specified than when the first print mode is specified and so that when either of the first print mode or the second print mode is specified, the first ink droplets are not ejected to the unit area where the number of ejected second ink droplets is at a maximum.

2. The inkjet printing method according to claim 1, wherein the maximum number of second ink droplets ejected per unit area and the maximum total number of first and second ink droplets ejected per unit area are larger when the first print mode is specified than when the second print mode is specified.

3. The inkjet printing method according to claim 1, wherein a density range in which the first ink droplet is used is wider when the first print mode is specified than when the second print mode is specified.

4. The inkjet printing method according to claim 1, wherein the first print mode has a density range including a first density range, second density range that is higher than the first density range, and third density range that is higher than the second density range, wherein in the first density range of the first print mode, the number of first ink droplets to be ejected is gradually increased to the maximum number of first ink droplets with increasing density, wherein in the second density range of the first print mode, the number of second ink droplets to be ejected is gradually increased while keeping the number of first ink droplets to be ejected at the maximum number of first ink droplets with increasing density, and wherein in the third density range of the first print mode, the number of second ink droplets to be ejected is gradually increased while decreasing the number of first ink droplets to be ejected with increasing density.

5. An inkjet printing apparatus for printing an image on a print medium by ejecting ink droplets from a print head on the basis of print data while moving the print head in a direction crossing a predetermined direction, the print head comprising at least a first nozzle array having a plurality of nozzles which are arranged in the predetermined direction and a second nozzle away having a plurality of nozzles which are arranged in the predetermined direction, a color of a first ink droplet ejected from the first nozzle array being the same color as a second ink droplet ejected from the second nozzle array and an amount of ink ejected in the first ink droplet ejected from the first nozzle array being less than an amount ejected in the second ink droplet ejected from the second nozzle array, the apparatus comprising:

a specifying unit that specifies one of a plurality of print modes including a first print mode in which the print head is moved at a first moving speed in order to print the image on the print medium and a second print mode in which the print head is moved at a second moving speed faster than the first moving speed in order to print the image on the print medium; and a conversion unit that converts input image data into the print data corresponding to each of the first and second nozzle arrays so that the maximum number of smaller ink droplets ejected per unit area of the print medium is smaller when the second print mode is specified than when the first print mode is specified and so that when either of the first print mode or the second print mode is specified, the smaller ink droplets are not ejected to the unit area to which the larger ink droplets, whose number is at a maximum, are ejected.

6. A program which causes a computer to execute a process of generating print data used to print an image on a print medium by ejecting ink droplets from a print head while moving the print head in a direction crossing a predetermined direction, the print head comprising at least a first nozzle away having a plurality of nozzles which are arranged in the predetermined direction and a second nozzle array having a plurality of nozzles which are arranged in the predetermined direction, a color of a first ink droplet ejected from the first nozzle array being the same color as a second ink droplet ejected from the second nozzle away and an amount of ink ejected in the first ink droplet ejected from the first nozzle away being less than an amount ejected in the second ink droplet ejected from the second nozzle array, the process comprising:

specifying one of a plurality of print modes including a first print mode in which the print head is moved at a first moving speed in order to print the image on the print medium and a second print mode in which the print head is moved at a second moving speed faster than the first moving speed in order to print the image on the print medium; and convening input image data into the print data corresponding to each of the first and second nozzle arrays so that the maximum number of first ink droplets ejected per unit area of the print medium is smaller when the second print mode is specified than when the first print mode is specified and so that when either of the first print mode or the second print mode is specified, the first ink droplets are not ejected to the unit area where the number of ejected second ink droplets is at a maximum.

* * * * *

UNITED STATES PATENT AND TRADEMARK OFFICE

CERTIFICATE OF CORRECTION

PATENT NO. : 7,350,893 B2
APPLICATION NO. : 11/515846
DATED : April 1, 2008
INVENTOR(S) : Minoru Teshigawara et al.

It is certified that error appears in the above-identified patent and that said Letters Patent is hereby corrected as shown below:

ON TITLE PAGE AT (75) INVENTORS

"Kiichiro Takahashi, Yokohama (JP)" should read --Kiichiro Takahashi, Kawasaki (JP)--.

COLUMN 4

Line 37, "same" should read --the same--;
Line 50, "arrays" should read --arrays,--; and
Line 65, "arrays" should read --arrays,--.

COLUMN 5

Line 18, "arrays" should read --arrays,--; and
Line 31, "arrays" should read --arrays,--.

COLUMN 8

Line 1, "operate" should read --operates--.

COLUMN 20

Line 48, "second" should read --a second--; and
Line 49, "third" should read --a third--.

COLUMN 21

Line 3, "away" should read --array--.

UNITED STATES PATENT AND TRADEMARK OFFICE

CERTIFICATE OF CORRECTION

PATENT NO. : 7,350,893 B2
APPLICATION NO. : 11/515846
DATED : April 1, 2008
INVENTOR(S) : Minoru Teshigawara et al.

It is certified that error appears in the above-identified patent and that said Letters Patent is hereby corrected as shown below:

COLUMN 22

Line 2, “away” should read --array--;
Line 7, “away” should read --array--;
Line 9, “away” should read --array--; and
Line 19, “convening” should read --converting--.

Signed and Sealed this

Seventh Day of October, 2008

JON W. DUDAS
*Director of the United States Patent and Trademark Office*